US009401112B2

(12) United States Patent
Ohara et al.

(10) Patent No.: US 9,401,112 B2
(45) Date of Patent: Jul. 26, 2016

(54) DISPLAY DEVICE AND METHOD OF DRIVING THE SAME

(71) Applicant: Sharp Kabushiki Kaisha, Osaka (JP)

(72) Inventors: Masanori Ohara, Osaka (JP); Noboru Noguchi, Osaka (JP); Noritaka Kishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 28 days.

(21) Appl. No.: 14/411,377

(22) PCT Filed: Jul. 24, 2013

(86) PCT No.: PCT/JP2013/069999
§ 371 (c)(1),
(2) Date: Dec. 24, 2014

(87) PCT Pub. No.: WO2014/021158
PCT Pub. Date: Feb. 6, 2014

(65) Prior Publication Data

US 2015/0199932 A1 Jul. 16, 2015

(30) Foreign Application Priority Data

Jul. 31, 2012 (JP) ..... 2012-169592

(51) Int. Cl.
*G09G 5/00* (2006.01)
*G09G 3/32* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ..... G09G 3/3233; G09G 3/3266; G09G 2300/0426; G09G 2300/0819; G09G 2300/0852; G09G 5/18; G09G 2310/0262; G09G 2320/043; G09G 3/3258; G09G 5/02; G09G 2300/0861
USPC ..... 345/76–84, 87–100, 204–215
See application file for complete search history.

(56) References Cited

U.S. PATENT DOCUMENTS 7,414,599 B2 * 8/2008 Chung ..... G09G 3/3233 315/169.3
7,545,351 B2 * 6/2009 Shin ..... G09G 3/325 345/76

(Continued)

FOREIGN PATENT DOCUMENTS

CN 101211535 A 7/2008
JP 2003-271095 A 9/2003

(Continued)

OTHER PUBLICATIONS

International Search Report received for PCT Patent Application No. PCT/JP2013/069999 mailed on Oct. 8, 2013, 4 pages.

(Continued)

*Primary Examiner* — Vijay Shankar
(74) *Attorney, Agent, or Firm* — Morrison & Foerster LLP

(57) ABSTRACT

An organic EL display device includes an emission driver that has an ON-control transistor (T1*e*) and an OFF-control transistor (T2*e*) for each emission line. The ON-control transistor (T1*e*) in the i-th row has its gate terminal and drain terminal connected to the scanning line (Si+1) in the (i+1)th row whereas its source terminal is connected to the emission line (EMi) in the i-th row. The OFF-control transistor (T2*e*) in the i-th row has its gate terminal connected to the scanning line (Si−1) in the (i−1)th row, whereas its drain terminal is connected to the emission line (EMi) in the i-th row, and its source terminal is connected to a LOW level logic power supply line (VSS).

12 Claims, 16 Drawing Sheets

(51) Int. Cl.
*G09G 5/02* (2006.01)
*G09G 5/18* (2006.01)

(52) U.S. Cl.
CPC . *G09G 5/02* (2013.01); *G09G 5/18* (2013.01); *G09G 2300/0426* (2013.01); *G09G 2300/0819* (2013.01); *G09G 2300/0852* (2013.01); *G09G 2300/0861* (2013.01); *G09G 2310/0262* (2013.01); *G09G 2320/043* (2013.01)

(56) References Cited

U.S. PATENT DOCUMENTS

| | | | | |
|---|---|---|---|---|
| 8,049,684 | B2 * | 11/2011 | Kim | G09G 3/3233 315/169.3 |
| 8,416,158 | B2 * | 4/2013 | Seto | G09G 3/3233 345/204 |
| 2004/0179005 | A1 | 9/2004 | Jo | |
| 2004/0189627 | A1 | 9/2004 | Shirasaki et al. | |
| 2005/0017934 | A1 | 1/2005 | Chung et al. | |
| 2005/0200572 | A1 | 9/2005 | Weng | |
| 2005/0206590 | A1 | 9/2005 | Sasaki et al. | |
| 2005/0264493 | A1 | 12/2005 | Shin | |
| 2007/0052644 | A1 | 3/2007 | Uchino et al. | |
| 2007/0118781 | A1 | 5/2007 | Kim | |
| 2008/0048955 | A1 | 2/2008 | Yumoto et al. | |
| 2008/0158110 | A1 | 7/2008 | Iida et al. | |
| 2009/0015571 | A1 | 1/2009 | Kawasaki et al. | |
| 2009/0033599 | A1 | 2/2009 | Kawasaki et al. | |
| 2009/0115707 | A1 | 5/2009 | Park et al. | |

FOREIGN PATENT DOCUMENTS

| | | | |
|---|---|---|---|
| JP | 2005-31630 | A | 2/2005 |
| JP | 2005-346025 | A | 12/2005 |
| JP | 4637070 | B | 2/2011 |

OTHER PUBLICATIONS

International Search Report received for PCT Patent Application No. PCT/JP2013/070000 mailed on Sep. 10, 2013, 4 pages.

* cited by examiner

DISPLAY DEVICE AND METHOD OF DRIVING THE SAME

CROSS REFERENCE TO RELATED APPLICATIONS

This is a U.S. National Phase patent application of PCT/JP2013/069999, filed Jul. 24, 2013, which claims priority to Japanese Patent Application No. 2012-169592, filed Jul. 31, 2012, each of which is hereby incorporated by reference in the present disclosure in its entirety.

TECHNICAL FIELD

The present invention relates to display devices, and more specifically, to a display device which includes pixel circuits that have electro-optic elements such as organic EL (Electro Luminescence) elements, and to methods of driving the same.

BACKGROUND ART

Organic EL display devices are known for their thinness, high-quality image displaying capabilities and low power consumption. Organic EL display devices have a plurality of pixel circuits disposed in a matrix pattern. Each of the pixel circuits includes an organic EL element which is a self-luminous electro-optic element driven by an electric current; drive transistors; etc.

Conventionally, there is known an organic EL display device in which the pixel circuits include transistors (hereinafter called "emission control transistors") provided therein, for controlling emission/non-emission of the organic EL element, in order to suppress abnormal emission, for example, of the organic EL element which can occur when writing a data voltage into the pixel circuit. In such an organic EL display device, a plurality of pixel circuits are formed correspondingly to a plurality of scanning lines and a plurality of emission lines. Each of the scanning lines which corresponds to one of the pixel circuits controls data voltage writing timing. Each of the emission lines which corresponds to one of the pixel circuits controls emission/non-emission timing of the organic EL element. The scanning lines are driven by a scanning driver (scanning driving section). The emission lines are driven by an emission driver (emission control driving section).

In relation to the present invention, Patent Document 1 discloses an organic EL display device in which the scanning driver and the emission driver are integrated with each other. FIG. 15 is a circuit diagram for describing the configuration of the scanning driver and the emission driver (hereinafter, these will be collectively called "scanning/emission driver" and will be indicated with a reference symbol 300) disclosed in Patent Document 1. Herein, it is assumed that there are n (n represents an integer not smaller than 2) scanning lines and n emission lines. The scanning/emission driver 300 includes a shift register 310, n first NAND gates NAND1*i* through NAND1*n*; n NOR gates NOR11 through NOR1*n*; and n second NAND gates NAND21 through NAND2*n*. The first NAND gates NAND1*i* (i is an integer not smaller than 1 and not greater than n) in the i-th stage receives an output SRi and an output SRi+1 from the i-th stage and the (i+1)th stage of the shift register 310 as inputs, and supplies an output based on these to the emission line EMi in the i-th row. The NOR gate NOR1*i* in the i-th stage receives the output SRi and the output SRi+1 in the i-th stage and the (i+1)th stage of the shift register 310 as inputs. The second NAND gate NAND2*i* in the i-th stage receives an output OUTi from the NOR gate 1*i* in the i-th stage and a clip signal CLIP as inputs, and supplies an output based on these to the scanning line Si in the i-th row. In the scanning/emission driver 300, the scanning driver is implemented by the shift register 310, the n NOR gates NOR11 through 1*n*, and the n second NAND gates NAND21 through 2*n*, whereas the emission driver is implemented by the shift register 310 and the n first NAND gates NAND11 through 1*n*.

DOCUMENTS ON CONVENTIONAL ART

Patent Documents

Patent Document 1: Japanese Unexamined Patent Application Publication No. 2005-346025

Patent Document 2: Japanese Patent No. 4637070

SUMMARY OF THE INVENTION

Problems to be Solved by the Invention

The organic EL display device disclosed in Patent Document 1 requires the use of NAND gates (first NAND gates) in order to implement the emission driver. The first NAND gate NAND1*i* in the i-th row is provided by, for example, a CMOS (Complementary Metal Oxide Semiconductor) circuit as shown in FIG. 16. More specifically, the first NAND gate NAND1*i* in the i-th row is constituted by two p-channel transistors TP1, TP2 which are provided in parallel to each other between a power supply line for supplying a HIGH level logic power supply voltage VDD (hereinafter this line will be called "HIGH level logic power supply line" and indicated with the same reference symbol VDD as is the HIGH level logic power supply voltage) and a power supply line for supplying a LOW level logic power supply voltage VSS (hereinafter this line will be called "LOW level logic power supply line" and will be indicated with the same reference symbol VSS as the LOW level logic power supply voltage); and two n-channel transistors TN1, TN2 which are provided in series with the respective two p-channel transistors TP1, TP2 between the HIGH level logic power supply line VDD and the LOW level logic power supply line VSS. In other words, the organic EL display device disclosed in Patent Document 1 requires four transistors for each of the emission lines, and this increases the size of the emission driver circuit.

It is therefore an object of the present invention to provide a display device, such as an organic EL display device, which includes an emission driver (emission control driving section) of a reduced circuit size, and a driving method thereof.

Means for Solving the Problems

A first aspect of the present invention provides an active matrix display device, which includes:

a display section including a plurality of data lines, a plurality of scanning lines, a plurality of emission control lines along the respective scanning lines, and a plurality of pixel circuits disposed correspondingly to the data lines, the scanning lines and the emission control lines;

a scanning driving section configured to sequentially select the scanning lines; and an emission control driving section configured to drive the emission control lines.

In this display device, the pixel circuit includes:

an electro-optic element driven by an electric current;

a first input transistor having its control terminal connected to a corresponding one of the scanning lines, and configured to turn ON when said scanning line is selected;

a drive transistor provided in series with the electro-optic element, and configured to control a drive current that is to be supplied to the electro-optic element, in accordance with a data voltage supplied via a corresponding one of the data lines and the first input transistor; and an emission control transistor having its control terminal connected to a corresponding one of the emission control lines, and provided in series with the electro-optic element;

whereas the emission control driving section includes:

OFF-control switching elements each provided correspondingly to one of the emission control lines and configured to change an electric potential of said emission control line to an OFF level to turn OFF the emission control transistor in accordance with a state of one of the scanning lines which precede the scanning line that is along said corresponding emission control line or a state of the scanning line that is along said corresponding emission control line; and ON-control switching elements each provided correspondingly to one of the emission control lines and configured to change the electric potential of the emission control line to an ON level to turn ON the emission control transistor in accordance with a state of one of the scanning lines which follow the scanning line that is along said corresponding emission control line.

A second aspect of the present invention provides the first aspect of the present invention, in which the OFF-control switching element changes the electric potential of the emission control line to the OFF level when one of the scanning lines which precede the scanning line that is along the corresponding emission control line or the scanning line that is along the corresponding emission control line changes its state to a selected state, and the ON-control switching element changes the electric potential of the emission control line to the ON level when one of the scanning lines which follow the scanning line that is along the corresponding emission control line changes its state to a selected state.

A third aspect of the present invention provides the second aspect of the present invention, in which the OFF-control switching element has its control terminal connected to one of the scanning lines which precede the scanning line that is along the corresponding emission control line or the scanning line that is along the corresponding emission control line, and has its first conduction terminal connected to the emission control lines, whereas the ON-control switching element has its control terminal connected to one of the scanning lines which follow the scanning line that is along the corresponding emission control line, and has its first conduction terminal connected to the emission control line.

A fourth aspect of the present invention provides the third aspect of the present invention, in which the first input transistor and the emission control transistor are of a same conductivity type, the OFF-control switching element has its second conduction terminal supplied with the OFF-level voltage, and the ON-control switching element has its second conduction terminal connected to the scanning line to which the control terminal is connected.

A fifth aspect of the present invention provides the third aspect of the present invention, in which the control terminal of the OFF-control switching element is connected to an immediately foregoing scanning line of the scanning line that is along the corresponding emission control line.

A sixth aspect of the present invention provides the third aspect of the present invention, in which the control terminal of the ON-control switching element is connected to an immediately following scanning line of the scanning line that is along the corresponding emission control line.

A seventh aspect of the present invention provides the first aspect of the present invention, in which the display device further includes a terminating end for each emission control line to be terminated.

An eighth aspect of the present invention provides the first aspect of the present invention, in which the pixel circuit further includes:

a drive capacitance element configured to hold a voltage for controlling the drive transistor; and a second input transistor having its control terminal connected to a foregoing one of the scanning lines of the corresponding scanning line. In this arrangement, the first input transistor and the second input transistor are parallel to each other between the corresponding data line and the drive capacitance element.

A ninth aspect of the present invention provides the eighth aspect of the present invention, in which the first input transistor is provided by a thin-film transistor which has its channel layer formed of an oxide semiconductor, a microcrystalline silicon or an amorphous silicon.

A tenth aspect of the present invention provides the first aspect of the present invention, in which both of the scanning driving section and the emission control driving section are disposed on one side of the display section.

An eleventh aspect of the present invention provides the first aspect of the present invention, in which the data voltage represents one of a plurality of primary colors, the pixel circuit serves as a sub-pixel for one of the primary colors, the display device further includes a time-sharing data voltage supply section configured to supply data voltages each representing one of the primary colors to the data lines in a time-sharing manner, and the scanning driving section selects one of the scanning lines when the pixel circuit corresponding thereto is supplied with the data voltage representing the primary color represented by said pixel circuit serving as a sub-pixel.

A twelfth aspect of the present invention provides a driving method of an active matrix display device including a display section having a plurality of data lines, a plurality of scanning lines, a plurality of emission control lines along the respective scanning lines, and a plurality of pixel circuits disposed correspondingly to the data lines, the scanning lines and the emission control lines; the pixel circuit including: a first input transistor having its control terminal connected to a corresponding one of the scanning lines, and configured to turn ON when said scanning line is selected; a drive transistor provided in series with the electro-optic element, and configured to control a drive current that is to be supplied to the electro-optic element, in accordance with a data voltage supplied via a corresponding one of the data lines and the first input transistor; and an emission control transistor having its control terminal connected to a corresponding one of the emission control lines, and provided in series with the electro-optic element. The method includes:

a scanning step of sequentially selecting the scanning lines; and an emission step of driving the emission control lines; and in this method, the emission control step includes:

an OFF-control step of controlling OFF-control switching elements each provided correspondingly to one of the emission control lines so as to change an electric potential of the emission control lines to an OFF level to turn OFF the emission control transistor in accordance with a state of one of the scanning lines which precede the scanning line that is along said corresponding emission control line or a state of the scanning line that is along said corresponding emission control line; and an ON-control step of controlling ON-control switching elements each provided correspondingly to one of the emission control lines so as to change the electric potential of the emission control line to an ON level to turn ON the emission control transistor in accordance with a state of one of the scanning lines which follow the scanning line that is along said corresponding emission control line.

Advantages of the Invention

According to the first aspect of the present invention, the OFF-control switching elements and the ON-control switching elements inside the emission control driving section control electric potentials in their corresponding emission control lines, whereby a plurality of emission control lines are driven. The emission control driving section makes use of a total of two switching elements, i.e., the OFF-control switching element and the ON-control switching element (each provided by a transistor for example) for each of the emission control lines. Therefore, it is possible to decrease the circuit size of the emission control driving section as compared to conventional ones.

According to the second aspect of the present invention, it is possible to drive the emission control line by changing the electric potential of the emission control line when the scanning line changes its state to the selected state.

According to the third aspect of the present invention, it is possible to control the electric potential of the emission control line, by controlling the OFF-control switching element with the electric potential of one of the scanning lines which precede the scanning line that is along the corresponding emission control line or of the scanning line that is along the corresponding emission control line, and by controlling the ON-control switching element with the electric potential of one of the scanning lines which follow the scanning line that is along the corresponding emission control line.

According to the fourth aspect of the present invention, the electric potential of the scanning line is utilized when changing the electric potential of the emission control lines to the ON level. This makes it possible to delete a power supply line to be used for changing the electric potential of the emission control line to the ON level.

According to the fifth aspect of the present invention, it is possible to change the electric potential of the emission control line to the OFF level when an immediately foregoing scanning line of the scanning line that is along the emission control line corresponding to the OFF-control switching element changes its state to the selected state.

According to the sixth aspect of the present invention, it is possible to change the electric potential of the emission control line to the ON level when an immediately following scanning line of the scanning line that is along the emission control line corresponding to the ON-control switching element changes its state to the selected state.

According to the seventh aspect of the present invention, the terminating end makes it possible to reliably maintain the electric potential of the emission control line.

According to the eighth aspect of the present invention, a voltage is supplied from the data line to the drive capacitance element via the second input transistor before a voltage is supplied from the data line to the drive capacitance element via the first input transistor. In other words, a preliminary charging is performed while the foregoing scanning line of the scanning line corresponding to the pixel circuit is selected. In this arrangement, the drive capacitance element is charged to a desired voltage even in cases where the first input transistor has a relatively low electron mobility or where it is not possible to take a sufficient selection period for each scanning line. Therefore, the arrangement makes it possible to maintain a level of display quality.

According to the ninth aspect of the present invention, a thin-film transistor (hereinafter abbreviated as "TFT") which has its channel layer formed of an oxide semiconductor, a microcrystalline silicon or an amorphous silicon is utilized as the first input transistor, and the aspect provides the same advantages as offered by the eighth aspect of the present invention.

According to the tenth aspect of the present invention, the scanning driving section and the emission control driving section are disposed on the same side with respect to the display section. This allows the emission control driving section to use sharper scanning line signals which have less deterioration in the waveform. Therefore, emission control driving section can accurately drive the emission control lines.

According to the eleventh aspect of the present invention, data voltages each representing one of a plurality of primary colors are supplied to the respective data lines in a time-sharing manner. Therefore, it is possible to decrease the size of the data voltage output circuit.

According to the twelfth aspect of the present invention, the same advantages as offered by the first aspect of the present invention are provided in a driving method of the display device.

MODE FOR CARRYING OUT THE INVENTION

Hereinafter, a first through a third embodiments of the present invention will be described with reference to the attached drawings. Hereinafter, each of the following letters m, n, k and l represents an integer not smaller than 2, whereas a letter i represents an integer not smaller than 1 but not greater than n. Also, a letter j represents an integer not smaller than 1 but not greater than m in the first and the second embodiments, but represents an integer not smaller than 1 but not greater than k in the third embodiment. Additionally, transistors included in pixel circuits in each of the embodiments are provided by field-effect transistors, typically by thin-film transistors.

1. First Embodiment

1. 1 Overall Configuration

Figure 1:
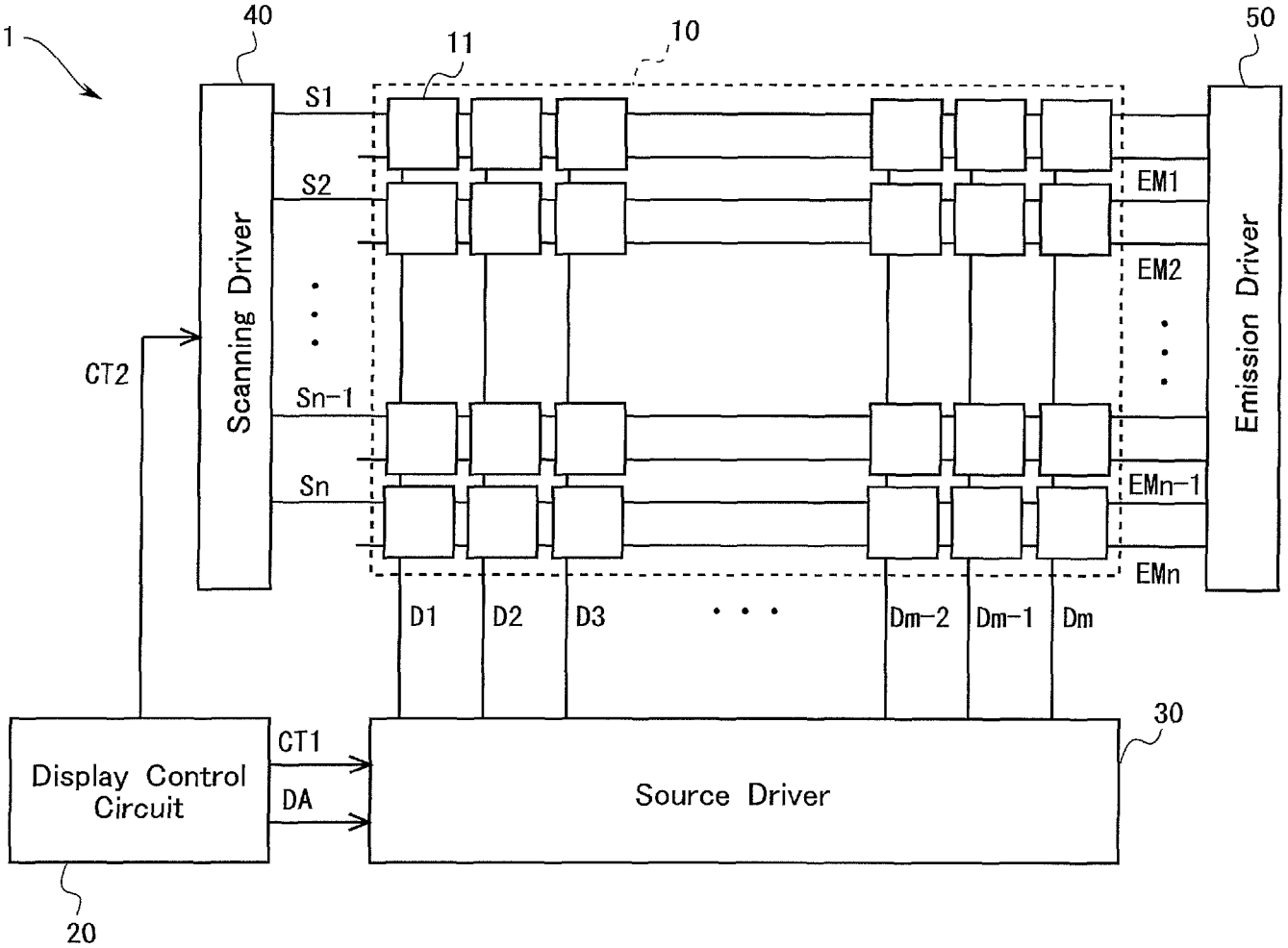
FIG. 1 is a block diagram showing a configuration of an organic EL display device according to a first embodiment of the present invention.

FIG. 1 is a block diagram showing a configuration of an active matrix organic EL display device 1 according to a first embodiment of the present invention. The organic EL display device 1 includes a display section 10, a display control circuit 20, a source driver 30, a scanning driver 40 and an emission driver 50. In the present embodiment, the source driver 30 represents the data driving section, the scanning driver 40 represents the scanning driving section, and the emission driver 50 represents the emission control driving section. It is acceptable that one or two, or all of the source driver 30, the scanning driver 40 and the emission driver 50 are formed integrally with the display section 10. The scanning driver 40 and the emission driver 50 are disposed on one side (hereinafter called "left side") and on another side (hereinafter called "right side") of the display section 10 respectively. It is acceptable, however, that the scanning driver 40 is on the right side and the emission driver 50 is on the left side of the display section 10.

The display section 10 has as many as m data lines D1 through Dm, and perpendicular thereto, n scanning lines S1 through Sn. Hereinafter, the direction in which the data lines extend will be called column direction, whereas the direction in which the scanning lines extend will be called row direction. Also, an array of constituent elements along the column direction may sometimes be called "column", whereas an array of constituent elements along the row direction may be called "row". The display section 10 further has m×n pixel circuits 11 correspondingly to the m data lines D1 through Dm and the n scanning lines S1 through Sn. Each pixel circuit 11 serves as one of a red (R) sub-pixel (hereinafter called "R sub-pixel", a green (G) sub-pixel (hereinafter called "G sub-pixel") and a blue (B) sub-pixel (hereinafter called "B sub-pixel"). The pixel circuits 11 along the row direction constitutes the R sub-pixel, the G sub-pixel, and the B sub-pixel in this order for example, from a side closer to the scanning driver 40. The colors represented by the sub-pixels are not limited to red, green and blue, but may be cyan, magenta, yellow, etc. The display section 10 also includes unillustrated power supply lines; i.e. a power supply line which supplies a HIGH level pixel supply-power voltage ELVDD (hereinafter this line will be called "HIGH level pixel power supply line" and will be indicated with the same reference symbol ELVDD as of the HIGH level pixel supply-power voltage), and a power supply line which supplies a LOW level pixel supply-power voltage ELVSS (hereinafter this line will be called "LOW level pixel power supply line" and will be indicated with the same reference symbol ELVSS as of the LOW level pixel supply-power voltage). Each of the HIGH level pixel supply-power voltage ELVDD and LOW level pixel supply-power voltage ELVSS is a fixed voltage.

The display control circuit 20 controls the source driver 30 and the scanning driver 40 by sending image data DA and a source control signal CT1 to the source driver 30 while sending a scanning control signal CT2 to the scanning driver 40. The source control signal CT1 contains, for example, a source start pulse signal, a source clock signal and a latch strobe signal. The scanning control signal CT2 contains, for example, a scanning start pulse signal and a scanning clock signal.

The source driver 30 is connected to the m data lines D1 through Dm, and drives them. More specifically, the source driver 30 has such unillustrated components as a shift register, a sampling circuit, a latch circuit, m D/A converters and m buffers. The shift register makes sequential transfer of the source start pulse in synchronization with the source clock, thereby making a sequential output of the sampling pulse. The sampling circuit sequentially stores one-row amount of image data DA following the timing given by the sampling pulse. The latch circuit receives and stores the one-row amount of image data DA held by the sampling circuit, in accordance with the latch strobe signal, while it supplies image data DA (hereinafter called "gradation data") contained in the one-row amount of image data for each sub-pixel to a corresponding one of the D/A converters. The D/A converter converts the supplied gradation data into a data voltage, and outputs the voltage. The data voltage outputted from the D/A converter is then supplied to a corresponding one of the data lines via a corresponding one of the buffers.

The scanning driver 40 is connected to the n scanning lines S1 through Sn, and drives them. More specifically, the scanning driver 40 has such unillustrated components as a shift register, n buffers, etc. The shift register makes sequential transfer of the scanning start pulse in synchronization with the scanning clock signal. The output signal from each stage of the shift register is then supplied to a corresponding one of the scanning lines via a corresponding one of the buffers. Following the process described above, the scanning driver 40 makes sequential selection from the n scanning lines S1 through Sn, starting from the scanning line S1.

The emission driver 50 is connected to the n emission lines EM1 through EMn, and drives them. The emission driver 50 has the unillustrated LOW level logic power supply line VSS. Details of the emission driver 50 will be described later.

1. 2 Pixel Circuit

Figure 2:
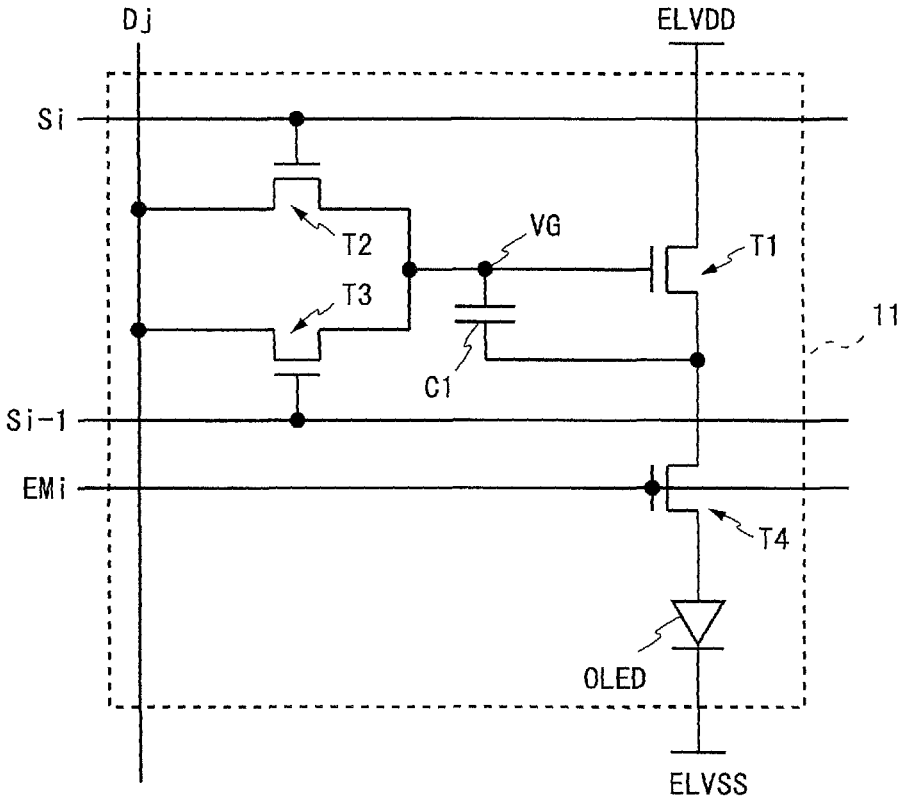
FIG. 2 is a circuit diagram showing a configuration of a pixel circuit in FIG. 1.

FIG. 2 is a circuit diagram showing a configuration of a pixel circuit located in the i-th row of the j-th column of the device shown in FIG. 1. The pixel circuit 11 has one organic EL element OLED, four transistors T1 through T4, and one capacitor C1. The transistor T1 serves as the drive transistor, the transistor T2 serves as the first input transistor, the transistor T3 serves as the second input transistor, and the transistor T4 serves as the emission control transistor. The capacitor C1 represents the drive capacitance element, whereas the organic EL element OLED represents the electro-optic element driven by an electric current. All of the transistors T1 through T4 are n-channel TFTs.

The transistor T1 is in series with the organic EL element OLED, and has its drain terminal, which serves as the first conduction terminal, connected to the HIGH level pixel power supply line ELVDD. The transistor T2 has its gate terminal (which serves as the control terminal; the same applies to gate terminals of the other transistors) connected to the scanning line Si in the i-th row, and is between the data line Dj and the gate terminal of the transistor T1. The transistor T3 has its gate terminal connected to the scanning line Si−1, i.e., the scanning line in the (i−1)th row which is immediately before the scanning line Si in the i-th row; and is between the data line Dj and the gate terminal of the transistor T1. The term "the scanning line immediately before" refers to a scanning line which is immediately before in the sequence of selection. The transistor T4 has its gate terminal connected to the emission line EMi in the i-th row, and is between the source terminal of the transistor T1 which serves as the second conduction terminal and an anode terminal of the organic EL element OLED. The capacitor C1 has its one terminal connected to the gate terminal of the transistor T1, and the other terminal connected to the source terminal of the transistor T1. The capacitor C1 holds a voltage VGS across the gate and the source of the transistor T1. The organic EL element OLED has its cathode terminal connected to the LOW level pixel power supply line ELVSS. In the present embodiment, a term "gate node VG" will be used for the sake of convenience to refer to a point of connection between the gate terminal of the transistor T1, the terminal of the capacitor C1 and a conduction terminal of the transistor T2 which is located on the gate terminal side of the transistor T1.

1. 3 Emission Driver

Figure 3:
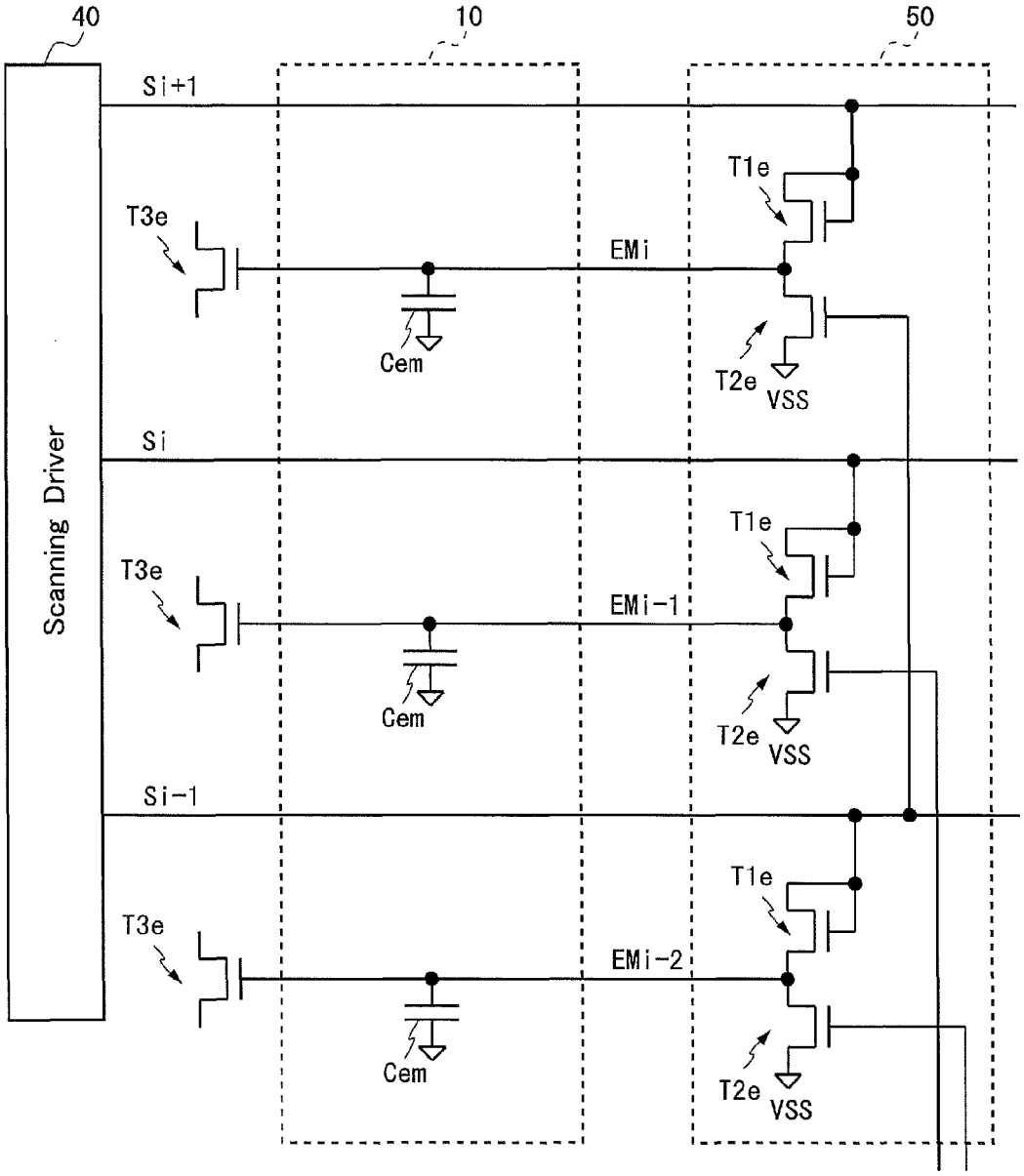
FIG. 3 is a circuit diagram for describing a configuration of an emission driver in FIG. 1.

FIG. 3 is a circuit diagram for describing a configuration of the emission driver 50 in FIG. 1. FIG. 3 shows a configuration of a portion covering the (i−2)th row through the i-th row for the sake of illustrative convenience. As described earlier, the scanning driver 40 is on the left side in the display section 10, whereas the emission driver 50 is on the right side in the display section 10. The emission driver 50 has an ON-control transistor T1*e* and an OFF-control transistor T2*e* for each emission line. The ON-control transistor T1*e* represents the ON-control switching element, whereas the OFF-control transistor T2*e* represents the OFF-control switching element. The ON-control transistor T1*e* and the OFF-control transistor T2*e* are provided by n-channel TFTs. For the sake of clarity, description hereinafter may concentrate on the emission line EMi in the i-th row and its relevant constituent elements, without covering emission lines in the other rows or their relevant constituent elements.

The ON-control transistor T1*e* which serves the emission line EMi in the i-th row (hereinafter this T1*e* will be called "the ON-control transistor T1*e* in the i-th row") causes an electric potential in the emission line EMi in the i-th row to change to ON level when the scanning line Si+1, which is the scanning line in the (i+1)th row immediately after the scanning line Si in the i-th row along the emission line EMi in the i-th row, has changed its state to Selected state. The term "the scanning line immediately after" refers to a scanning line which is immediately after in the sequence of selection. It should be noted here that the "scanning line is in Selected state" means that the scanning line has an ON-level electric potential (a level which turns ON the transistors in the pixel circuit 11). Also, the expression that the "scanning line is in De-selected state" means that the electric potential of the scanning line is at an OFF level (a level which turns OFF the transistors in the pixel circuit 11). In the present embodiment, the ON level and the OFF level are provided by the HIGH level (VDD) and the LOW level (VSS) respectively. The ON-control transistor T1*e* in the i-th row, or more specifically, its gate terminal and drain terminal which serves as the second conduction terminal are connected to the scanning line Si+1 in the (i+1)th row, whereas its source terminal, which serves as the first conduction terminal, is connected to the emission line EMi in the i-th row.

The OFF-control transistor T2*e* which serves the emission line EMi in the i-th row (hereinafter this T2*e* will be called "the OFF-control transistor T2*e* in the i-th row") causes the electric potential in the emission line EMi in the i-th row to change to OFF level when the scanning line Si−1, which is the scanning line in the (i−1)th row immediately before the scanning line Si in the i-th row along the emission line EMi in the i-th row, has changed its state into Selected state. The OFF-control transistor T2*e* in the i-th row, or more specifically its gate terminal, is connected to the scanning line Si−1 in the (i−1)th row; its drain terminal, which serves as the first conduction terminal, is connected to the emission line EMi in the i-th row; and its source terminal, which serves as the second conduction terminal, is connected to the LOW level logic power supply line VSS. The LOW level logic power supply line VSS has an electric potential equivalent to the LOW level defined above.

Figure 4:
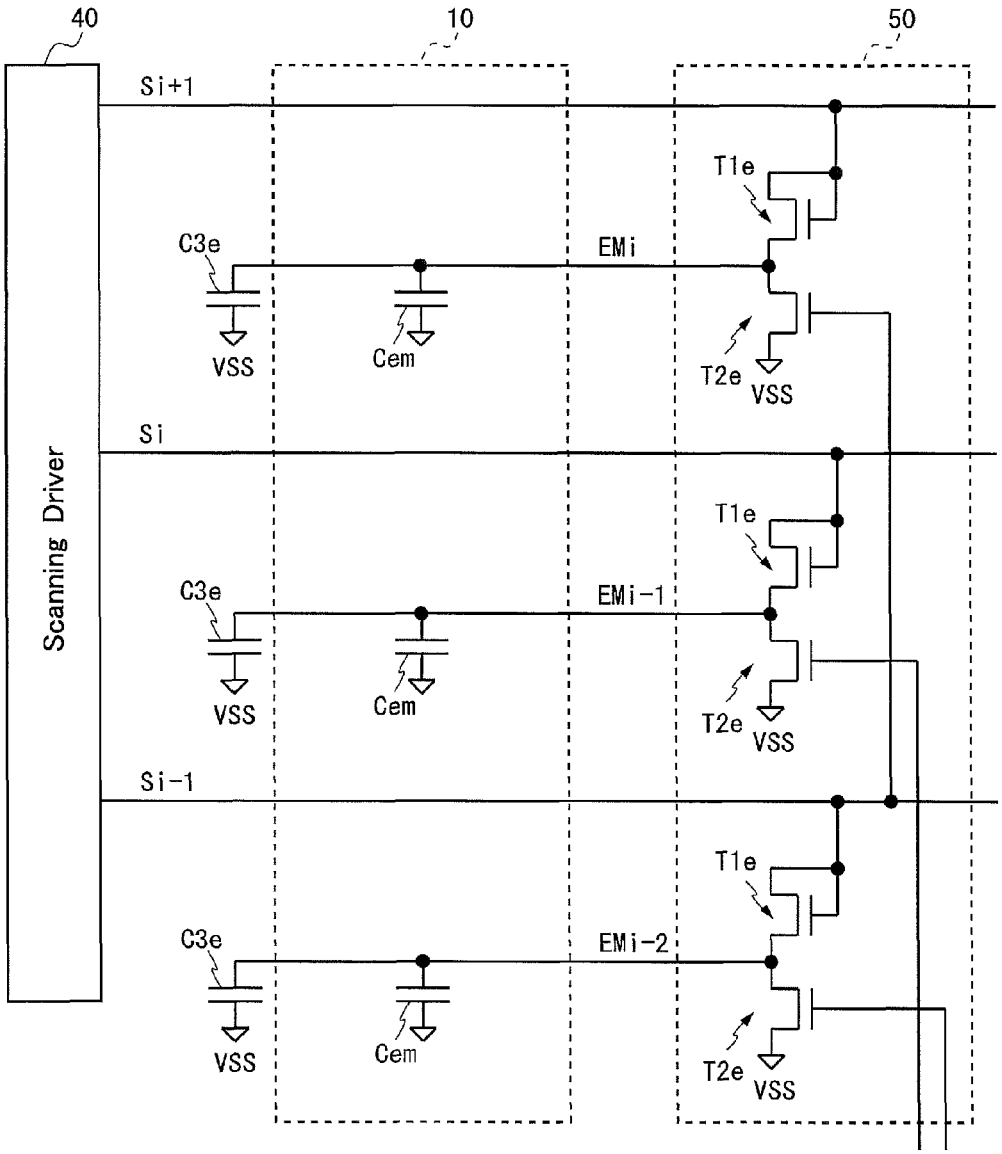
FIG. 4 is a circuit diagram for describing another configuration regarding an end of an emission line in the first embodiment.
Figure 5:
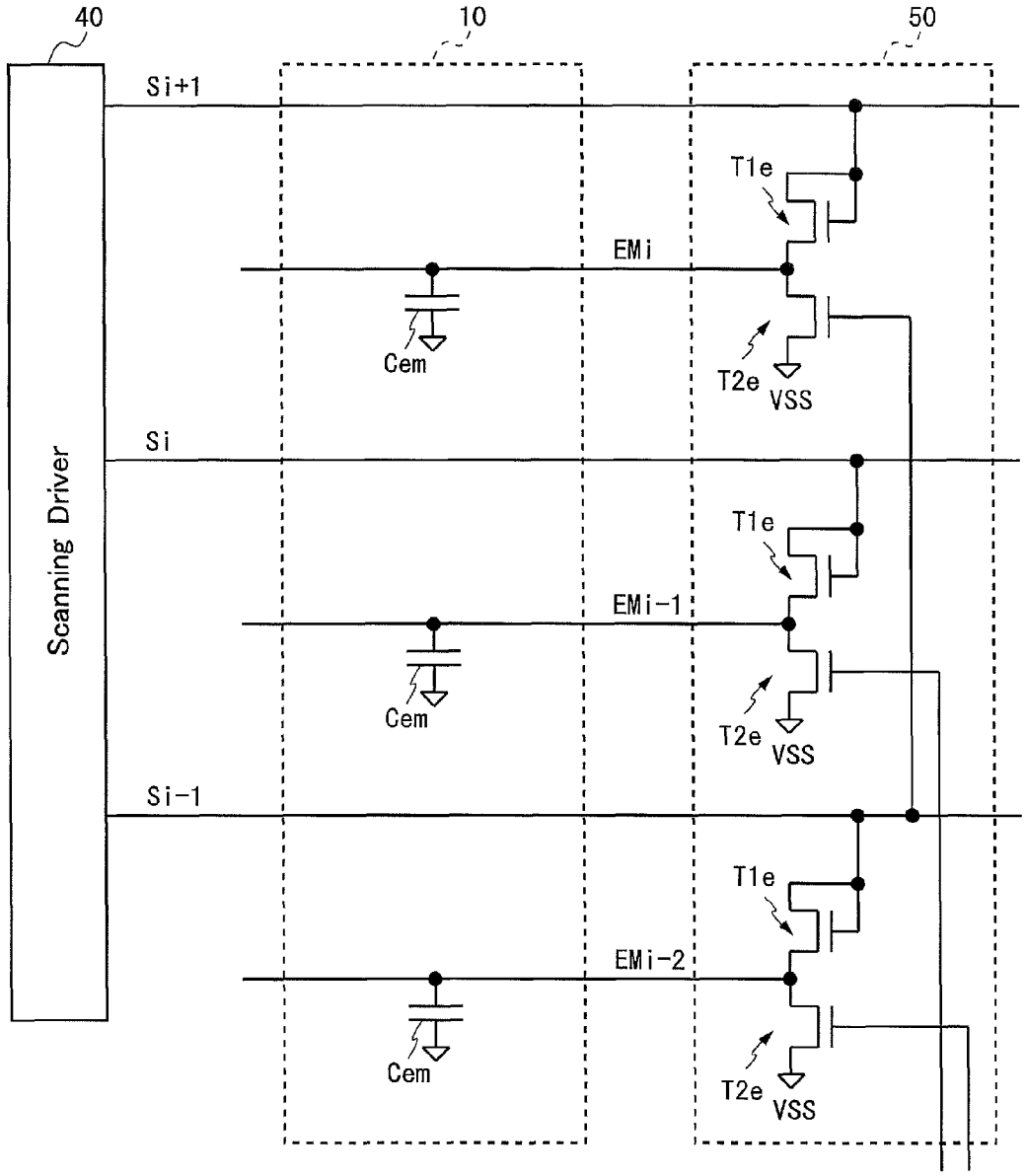
FIG. 5 is a circuit diagram for describing still another configuration regarding the end of the emission line in the first embodiment.

A reference symbol Cem in FIG. 3 indicates a total capacitance (a wire capacitance and a parasitic capacitance) in the emission line in each row. Also, in each row on the side closer to the scanning driver 40, the emission line has its end provided with a terminal transistor T3*e* as a terminating end for terminating the emission line. Each terminal transistor T3*e* is provided by an n-channel transistor, with its gate terminal connected to the end of the emission line. As a note, each terminal transistor T3*e* may be provided by a p-channel transistor. In each terminal transistor T3*e*, the source terminal and the drain terminal are floating for example. The terminal transistor T3*e* maintains the emission line is floating thereby ensuring that the electric potential in the emission line is reliably maintained when both of the ON-control transistor T1*e* and the OFF-control transistor T2*e* are in the OFF state. Alternatively, as shown in FIG. 4, the terminal transistor T3*e* may be replaced by a terminal capacitor C3*e* which has one terminal connected to the emission line, and the other terminal connected to the LOW level logic power supply line VSS for example. This arrangement can also maintain the emission line floating thereby ensuring that the electric potential in the emission line is reliably maintained when both of the ON-control transistor T1*e* and the OFF-control transistor T2*e* are in the OFF state. Still another alternative can be that, as shown in FIG. 5, there is no terminating end provided such as the terminal transistor T3*e* and the terminal capacitor C3*e*. Even in this case, it is possible to maintain the emission line floating thereby maintaining the electric potential in the emission line due to the emission line capacitance Cem, when both of the ON-control transistor T1*e* and the OFF-control transistor T2*e* are in the OFF state. In cases where the capacitance Cem of the emission line in each row is not large enough, it is more desirable, than providing the terminal transistor T3*e*, to provide the terminal capacitor C3*e* since it functions as an additional capacitance to the capacitance Cem.

1. 4 Operation

Figure 6:
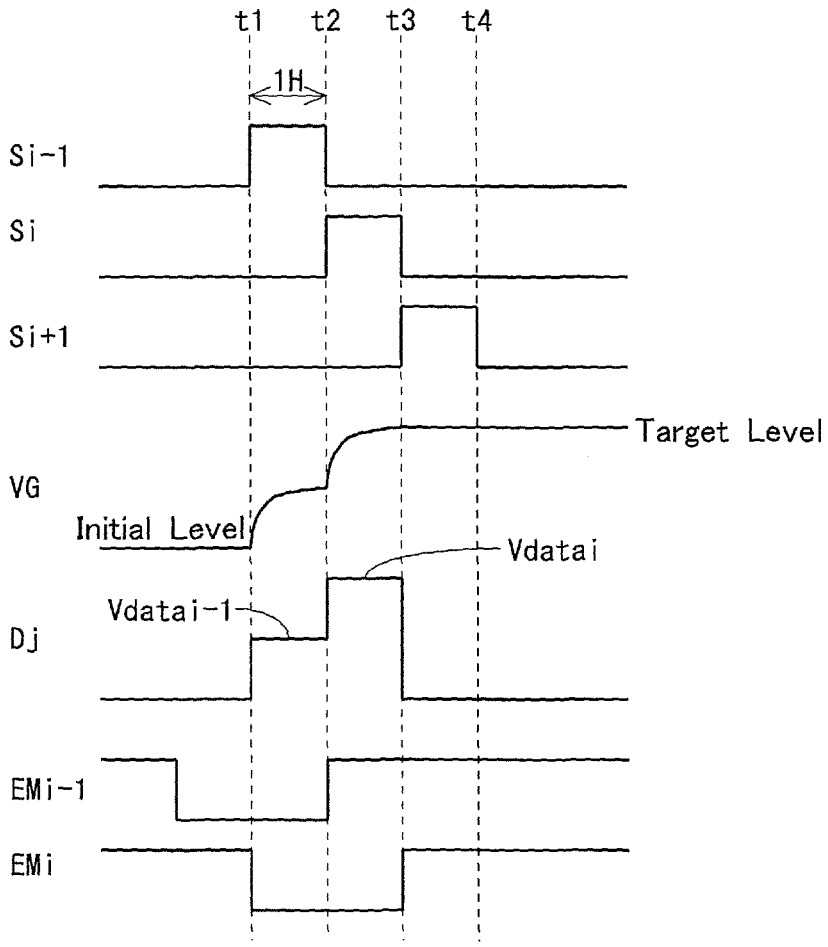
FIG. 6 is a timing chart for describing an operation of the pixel circuit in FIG. 2 and that of the emission driver in FIG. 3.

FIG. 6 is a timing chart for describing an operation of the pixel circuit 11 in FIG. 2 and an operation of the emission driver 50 in FIG. 3. First, reference will be made to FIG. 2 and FIG. 6 to describe an operation of the pixel circuit 11 shown in FIG. 2. In FIG. 6, a period from Time t1 through Time t2 is a selection period for the scanning line Si−1 in the (i−1)th row; a period from Time t2 through Time t3 is a selection period for the scanning line Si in the i-th row; and a period from Time t3 through Time t4 is a selection period for the scanning line Si+1 in the (i+1)th row. Hereinafter, the selection period for the scanning line Si in the i-th row will be called "selection period for the i-th row". As shown in FIG. 6, the emission line EMi in the i-th row assumes LOW level during selection periods for the scanning lines Si−1 and Si of the (i−1)th row and the i-th row. This LOW level period partially overlaps a LOW level period of the emission line EMi−1 in the (i−1)th row, for one horizontal period (1 H period).

Before Time t1, the scanning lines Si−1 through Si+1 in the (i−1)th row through the (i+1)th row assume LOW level, whereas the emission line EMi in the i-th row assumes HIGH level. Under this state, the transistors T2, T3 are turned OFF, so the gate node VG maintains an initial potential level. It should be noted here that the initial level may be set to a ground potential by selecting all the scanning lines and bringing all the data lines to a ground potential during the blanking period after all the scanning lines are scanned. The transistor T4 is in ON state, and therefore there is a mutual electric connection between the source terminal of the transistor T1 and the anode terminal of the organic EL element OLED. Thus, the transistor T1 supplies a drive current determined by the initial level, to the organic EL element OLED, and the organic EL element OLED is emitting light at a brightness determined by the drive current.

When Time t1 is reached, the emission line EMi in the i-th row changes its state to LOW level, so the transistor T4 turns OFF. This causes electrical disconnection between the source terminal of the transistor T1 and the anode terminal of the organic EL element OLED. As a result, the supply of the drive current by the transistor T1 to the organic EL element OLED is stopped and the organic EL element OLED stops its emission. This suppresses abnormal emission of the organic EL element OLED which can occur when supplying a data voltage to the gate node VG. The emission line EMi in the i-th row stays LOW level until Time t3. Meanwhile, as Time t1 is reached, the scanning line Si−1 in the (i−1)th row changes its state to HIGH level, so the transistor T3 turns ON. As a result, a data voltage Vdatai−1 in the (i−1)th row is supplied to the gate node VG via the data line Dj and the transistor T3. Thereafter, for a period until Time t2 is reached, the potential at the gate node VG varies following the data voltage Vdatai−1 in the (i−1) th row. In this process, the capacitor C1 is charged with a differential potential between the potential at the gate node VG and a source potential of the transistor T1, i.e. to the gate-source voltage Vgs. As described above, a preliminary charging is performed in the pixel circuit 11 in the i-th row during the selection period in the (i−1)th row, in the present embodiment. The preliminary charging as described above brings the potential at the gate node VG closer to a target level (Vdatai) which must be achieved in the selection period for the i-th row.

When Time t2 is reached, the scanning line Si−1 in the (i−1)th row changes its state to LOW level, so the transistor T3 turns OFF. Also, the scanning line Si in the i-th row changes its state to HIGH level, so the transistor T2 turns ON. As a result, the data voltage Vdatai in the i-th row is supplied to the gate node VG via the data line Dj and the transistor T2. Thereafter, for a period until Time t3 is reached, the potential at the gate node VG varies following the data voltage Vdatai in the i-th row. In this process, the capacitor C1 is charged with a differential potential between the potential at the gate node VG and a source potential of the transistor T1, i.e. to the gate-source voltage Vgs. More specifically, since the above-described preliminary charging has already brought the potential at the gate node VG close to the data voltage Vdatai in the i-th row, the potential at the gate node VG reliably achieves Vdatai in the selection period for the i-th row. In the selection period for the i-th row, the gate-source voltage Vgs to which the capacitor C1 is charged is given by the following mathematical expression (1):

$$\begin{aligned} Vgs &= VG - VS \\ &= Vdatai - VS \end{aligned} \tag{1}$$

where VS represents the source potential of the transistor T1, and is assumed as a constant for the convenience of description.

When Time t3 is reached, the scanning line Si in the i-th row changes its state to LOW level, so the transistor T2 turns OFF. This finalizes the value of the gate-source voltage Vgs held by the capacitor C1 to the value given by the mathematical expression (1). Also at Time t3, the emission line EMi in the i-th row changes its state to HIGH level, so an electrical connection is made between the source terminal of the transistor T1 and the anode terminal of the organic EL element OLED. Thus, the transistor T1 supplies a drive current Ioled to the organic EL element OLED depending upon the gate-source voltage Vgs held by the capacitor C1. More specifically, the drive current Ioled supplied from the transistor T1 to the organic EL element OLED is given by the following mathematical expression (2):

$$\begin{aligned} Ioled &= (\beta/2)*(Vgs - Vth)^2 \\ &= (\beta/2)*(Vdatai - VS - Vth)^2 \end{aligned} \tag{2}$$

where β represents a gain of the transistor T1, which is proportional to electron mobility of the transistor T1 for example. As indicated by the above mathematical expression (2), the drive current Ioled takes a value which is determined by the data voltage Vdatai in the i-th row, and therefore the organic EL element OLED makes emission at a brightness determined by the data voltage Vdatai in the i-th row. The transistor T1 supplies the drive current Ioled which is determined by the mathematical expression (2), to the organic EL element OLED also in periods after Time t4.

Next, reference will be made to FIG. 3 and FIG. 6, to describe an operation of the emission driver 50. Before Time t1, the scanning lines Si−1 and Si+1 in the (i−1)th row and the (i+1)th row assume LOW level, so both the ON-control transistor in the i-th row T1*e* and the OFF-control transistor T2*e* are in OFF state. This keeps the emission line EMi in the i-th row in a floating state, with its potential maintained at HIGH level.

When Time t1 is reached, the scanning line Si−1 in the (i−1) th row changes its state to HIGH level, so the OFF-control transistor T2*e* in the i-th row turns ON. This pulls down the potential in the emission line EMi in the i-th row to LOW level (VSS).

When Time t2 is reached, the scanning line Si−1 in the (i−1)th row changes its state to LOW level, so the OFF-control transistor T2*e* in the i-th row turns OFF. Both the ON-control transistor T1*e* and the OFF-control transistor T2*e* in the i-th row are in OFF state. This brings the emission line EMi in the i-th row into a floating state, with its potential maintained at LOW level.

When Time t3 is reached, the scanning line Si+1 in the (i+1) th row changes its state to HIGH level, so the ON-control transistor T1*e* in the i-th row turns ON. This pulls up the potential in the emission line EMi in the i-th row to HIGH level (VDD).

When Time t4 is reached, the scanning line Si+1 in the (i+1) th row changes its state to LOW level, so the ON-control transistor T1*e* in the i-th row turns OFF. Both the ON-control transistor T1*e* and the OFF-control transistor T2*e* in the i-th row are in OFF state. This brings the emission line EMi in the i-th row into a floating state, with its potential maintained at HIGH level. As has been described thus far, the operation of the emission driver 50 in the present embodiment is implemented by maintaining HIGH level and LOW level by utilizing the floating state of the emission lines which can be achieved by means of the ON-control transistor T1*e* and the OFF-control transistor T2*e*.

1. 5 Layout

Figure 7:
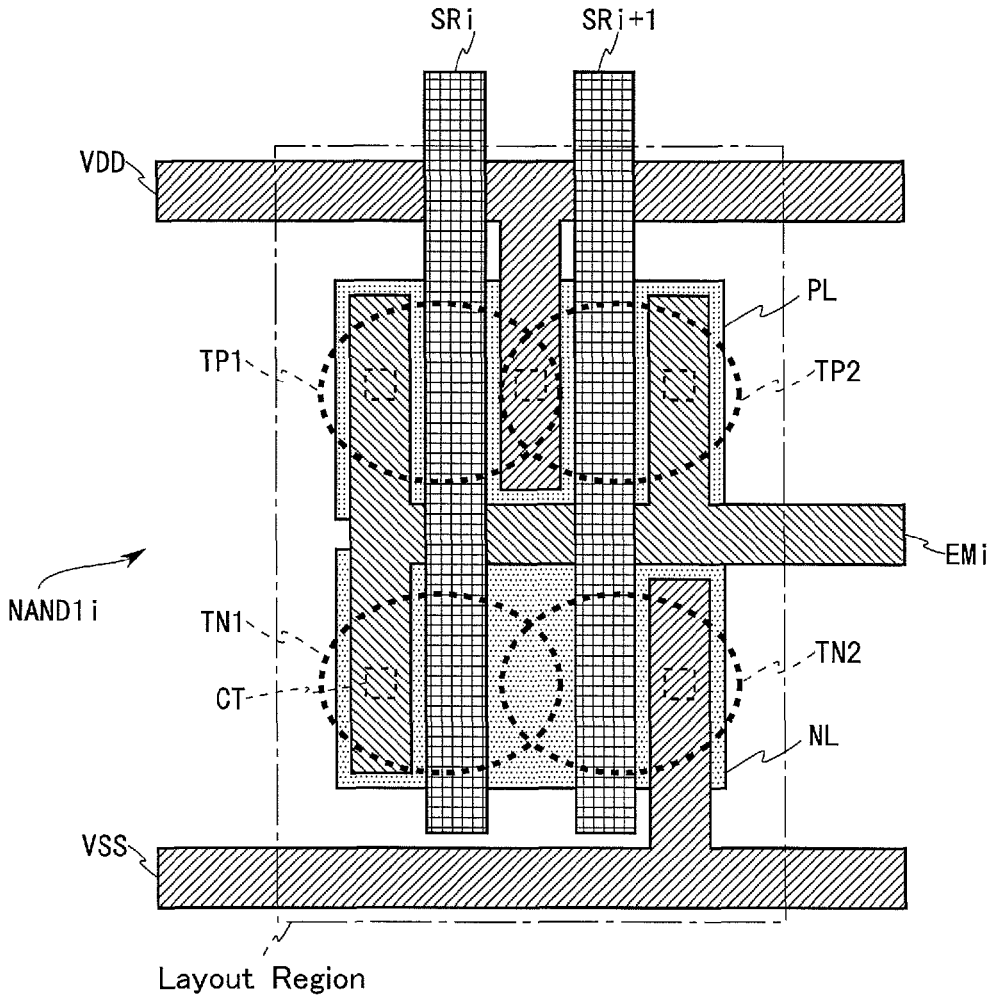
FIG. 7 shows a layout of NAND gates.

FIG. 7 is a diagram showing a layout in the first NAND gate NAND1*i* in the i-th row in the organic EL display device disclosed in Patent Document 1. FIG. 7 uses chain lines to show an approximate layout region where the first NAND gate NAND1*i* in the i-th row is. For simplicity, description will assume that all wires shown in FIG. 7 have the same width. The description of the layout hereinafter will not cover insulation layers, etc. Also, the description also assumes that each transistor is provided by a top-gate type although each of the transistors may be of a bottom-gate type.

Figure 16:
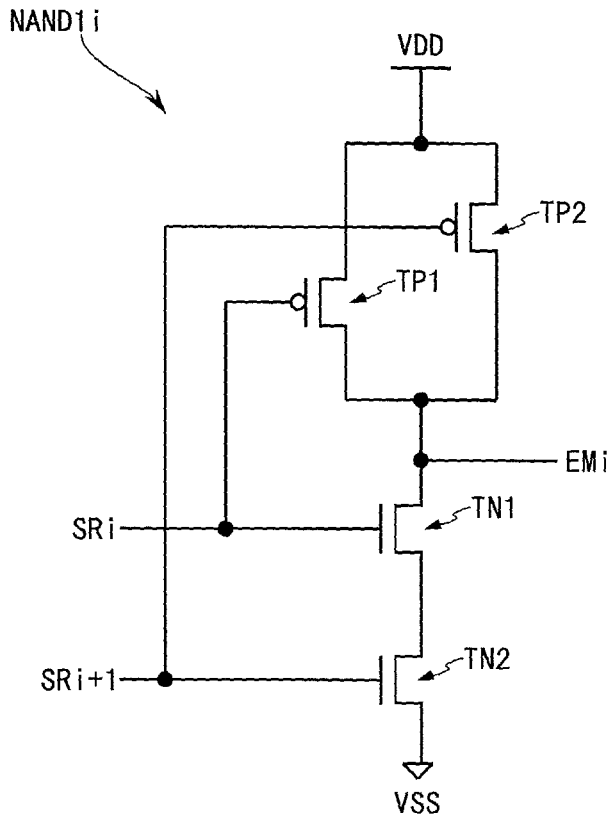
FIG. 16 is a circuit diagram showing a configuration of a NAND gate.

As shown in FIG. 7, at a place facing a p-channel layer (which is a channel layer provided by a p-type semiconductor device) PL, (more specifically, on the p-channel layer PL), there are the emission line EMi in the i-th row; a wire which supplies an output SRi in the i-th stage of the shift register 310 (hereinafter this wire will be called "the output line in the i-th row" and will be indicated with the same reference symbol Sri as in the i-th output); a wire which supplies an output SRi+1 in the (i+1)th stage of the shift register 310 (hereinafter this wire will be called "output line in the (i+1)th row" and will be indicated with the same reference symbol SRi+1 as of the output in the (i+1)th stage); and the HIGH level logic power supply line VDD. The p-channel layer PL is connected to the emission line EMi in the i-th row via a contact hole CT near its end (left end in FIG. 7); connected to the HIGH level logic power supply line VDD via a contact hole CT near its center; and connected to the emission line EMi in the i-th row via a contact hole CT near its another end (right end in FIG. 7). On the p-channel layer PL, the output line SRi in the i-th row is between the emission line EMi in the i-th row which is connected to near the left end of the p-channel layer PL via the contact hole CT and the HIGH level logic power supply line VDD, whereas the output line SRi+1 in the (i+1)th row is between the HIGH level logic power supply line VDD and the emission line EMi in the i-th row which is connected to near the right end of the p-channel layer PL via the contact hole CT. The p-channel layer PL, the emission line EMi in the i-th row, the HIGH level logic power supply line VDD, and the output line SRi in the i-th row which are located on the p-channel layer PL constitute the p-channel transistor TP1 shown in FIG. 16. The p-channel layer PL, the HIGH level logic power supply line VDD, the output line SRi+1 in the (i+1)th row, and the emission line EMi in the i-th row which are located on the p-channel layer PL constitute the p-channel transistor TP2 shown in FIG. 16.

At a place facing an n-channel layer (which is a channel layer provided by an n-type semiconductor device) NL, (more specifically, on the n-channel layer), there are the emission line EMi in the i-th row, the output line SRi in the i-th row, the output line SRi+1 in the (i+1)th row, and the LOW level logic power supply line VSS. The n-channel layer NL is connected to the emission line EMi in the i-th row via a contact hole CT near its end (left end in FIG. 7), and is connected to the LOW level logic power supply line VSS via a contact hole CT near its another end (right end in FIG. 7). On the n-channel layer NL, the output line SRi in the i-th row is on a side closer to the center of n-channel layer NL than is the emission line EMi in the i-th row, whereas the output line SRi+1 in the (i+1) th row is on a side closer to the center of n-channel layer NL than is the LOW level logic power supply line VSS. The n-channel layer NL, the emission line EMi in the i-th row and the output line SRi in the i-th row which are located on the the n-channel layer NL constitute the n-channel transistor TN1 shown in FIG. 16. The n-channel layer NL, and the output line SRi+1 in the (i+1) th row and the LOW level logic power supply line VSS which are located on the n-channel layer NL constitute the n-channel transistor TN2 shown in FIG. 16.

Figure 8:
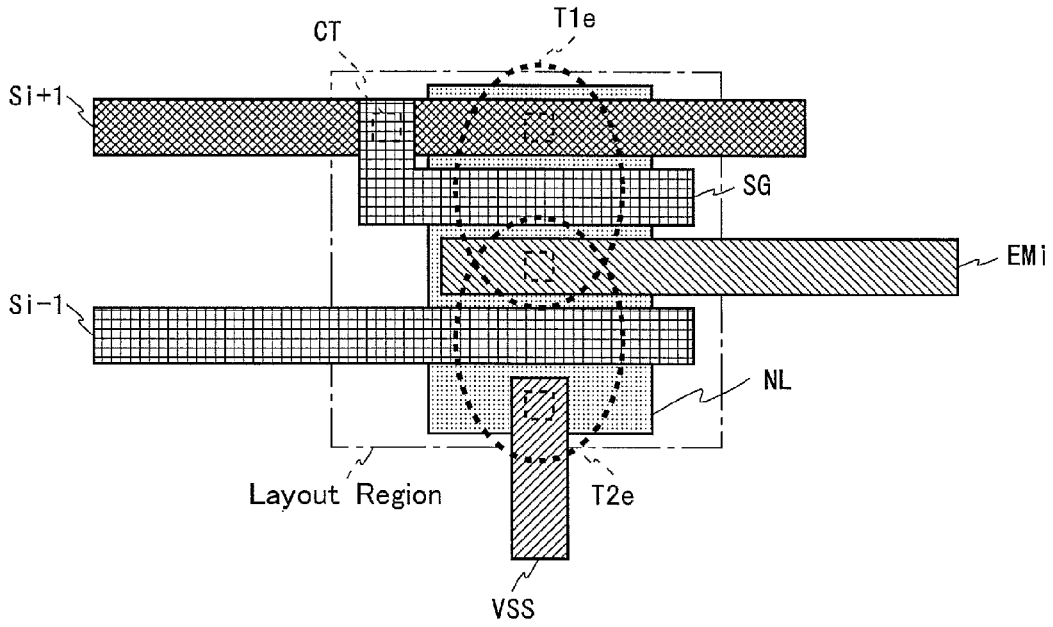
FIG. 8 shows a layout of an ON-control transistor and an OFF-control transistor in the i-th row.

FIG. 8 shows a layout of the ON-control transistor T1*e* and the OFF-control transistor T2*e* in the i-th row. FIG. 8 uses chain lines to show an approximate layout region where the ON-control transistor T1*e* and the OFF-control transistor T2*e* in the i-th row are. For simplicity, description will assume that all wires shown in FIG. 8 have the same width.

As shown in FIG. 8, at a place facing the n-channel layer NL (more specifically, on the n-channel layer NL), there are the scanning line Si+1 in the (i+1)th row; a gate-connection wire SG connected to the scanning line Si+1 in the (i+1)th row via a contact hole CT; the emission line EMi in the i-th row; the scanning line Si−1 in the (i−1)th row; and the LOW level logic power supply line VSS. The n-channel layer NL is connected to the scanning line Si+1 in the (i+1)th row via a contact hole CT near its end (upper end in FIG. 8); connected to the emission line EMi in the i-th row via a contact hole CT near its center; and connected to the scanning line Si−1 in the (i−1)th row via a contact hole CT near its another end (lower end in FIG. 8). On the n-channel layer NL, the gate-connection wire SG is between the scanning line Si+1 in the (i+1)th row and the emission line EMi in the i-th row, whereas the scanning line Si−1 in the (i−1)th row is between the emission line EMi in the i-th row and the LOW level logic power supply line VSS. The n-channel layer NL, the scanning line Si+1 in the (i+1)th row, the gate-connection wire SG and the emission line EMi in the i-th row which are located on the n-channel layer NL constitute the ON-control transistor T1*e* in the i-th row. The n-channel layer NL, the emission line EMi in the i-th row, the scanning line Si−1 in the (i−1)th row and the LOW level logic power supply line VSS which are located on the n-channel layer NL constitute the OFF-control transistor T2*e* in the i-th row.

As shown in FIG. 7 and FIG. 8, the layout area of the ON-control transistor T1*e* and OFF-control transistor T2*e* in the i-th row is approximately a half of the layout area required for cases where four transistors must be used to constitute the first NAND gate NAND1*i* in the i-th row. Specifically, the circuit size per emission line within the emission driver 50 according to the present embodiment is about a half of the circuit size in the organic EL display device disclosed in Patent Document 1.

<1. 6 Power Consumption>

Generally, an NAND gate which is implemented by a CMOS circuit generates a shoot-through current Ip at a time of transition when each of the two inputs changes from HIGH level to LOW level or from LOW level to HIGH level. Specifically, in the first NAND gate NAND1*i* in the i-th row shown in FIG. 16, when each in the i-th output SRi and the (i+1)th output SRi+1 in the shift register 310 changes their state from HIGH level to LOW level or from LOW level to HIGH level, the p-channel transistors TP1, TP2 (hereinafter, they will be called "p-channel transistors TP" when they are not differentiated from each other) and the n-channel transistors TN1, TN2 (hereinafter, they will be called "n-channel transistors TN" when they are not differentiated from each other) temporarily assume ON state simultaneously. This causes a shoot-through current Ip from the HIGH level logic power supply line VDD toward the LOW level logic power supply line VSS via the p-channel transistors TP and the n-channel transistors TN. The shoot-through current Ip is given by the following mathematical expression (3).

$$Ip=(\beta n/2)\times\{(VDD+Vtp-Vtn)/[1+\mathrm{sqrt}(\beta n/\beta p)]\}^2 \quad (3)$$

In the above, βn and βp represent gains of the n-channel transistors TN and the p-channel transistors TP respectively, and their values are determined by characteristics (e.g. electron mobility) of the re-channel transistors TN and the p-channel transistors TP respectively. Also, Vtn, Vtp represent threshold voltages of the n-channel transistors TN and the p-channel transistors TP respectively, which are positive and negative respectively. Note that VSS=0 in this description. Mathematical Expression (3) gives a relatively large shoot-through current Ip, which means that the organic EL display device disclosed in Patent Document 1 has a large power consumption by its emission driver.

On the other hand, in the emission driver 50 according to the present embodiment, there is no such complementary operations as in the CMOS circuit; namely, the OFF-control transistor T2*e* in the i-th row turns ON in the selection period of the scanning line Si−1 in the (i−1) th row, whereas the ON-control transistor T1*e* in the i-th row turns ON in the selection period of the scanning line Si+1 in the (i+1) th row. In other words, the OFF-control transistor T2*e* and the ON-control transistor T1*e* do not turn ON simultaneously with each other. Consequently therefore, no such current as the above-described shoot-through current Ip is generated.

1. 7 Advantages

According to the present embodiment, the ON-control transistor T1*e* and the OFF-control transistor T2*e* inside the emission driver 50 control an electric potential of an emission line assigned to them, and as many as n emission lines EM1 through EMn are driven by this method. More specifically, the n emission lines EM1 through EMn are driven by maintaining HIGH level or LOW level by utilizing the floating state of the emission lines which can be achieved by means of the ON-control transistor T1*e* and the OFF-control transistor T2*e*. The emission driver 50 requires a total of two transistors for each emission line, i.e., the ON-control transistor T1*e* and the OFF-control transistor T2*e*. Therefore, it is possible to decrease the circuit size of the emission driver 50 compared to the organic EL display device disclosed in the Patent Document 1.

Also, according to the present embodiment, the OFF-control transistor T2*e* in the i-th row turns ON in the selection period of the scanning line Si−1 in the (i−1)th row, whereas the ON-control transistor T1*e* in the i-th row turns ON in the selection period of the scanning line Si+1 in the (i+1)th row. Specifically, the OFF-control transistor T2*e* and the ON-control transistor T1*e* do not turn ON simultaneously with each other. Since this prevents generation of such a current as the above-described shoot-through current Ip, power consumption by the emission driver 50 is smaller than by the organic EL display device disclosed in Patent Document 1.

According to the present embodiment, the transistors T2 through T4 are of the same conductivity type as each other, and when changing the potential of emission line to HIGH level, the diode-connected ON-control transistor T1*e* makes use of the potential in the scanning line. This makes it possible to delete the power supply line (HIGH level logic power supply line VDD) to be used for changing the potential in the emission line to HIGH level in the emission driver 50.

According to the present embodiment, a data voltage Vdatai−1 in the (i−1)th row is supplied from the data line Dj to the capacitor C1 via the transistor T3 before the data voltage Vdatai in the i-th row is supplied from the data line Dj to the capacitor C1 via the transistor T2. In other words, a preliminary charging is performed in the selection period of the immediately foregoing scanning line Si−1. Therefore, the capacitor C1 is charged to a desired gate-source voltage Vgs even in cases where the transistor T2 has a relatively low electron mobility or where it is not possible to take a sufficient selection period for each scanning line. This makes it possible to maintain a level of display quality. The present embodiment is suitable for cases where the transistor T2 is provided by a TFT of a relatively low electron mobility such as an oxide TFT (a TFT whose channel layer is formed of an oxide semiconductor), a microcrystalline silicon TFT (a TFT whose channel layer is formed of a microcrystalline silicon), and an amorphous silicon TFT (a TFT whose channel layer is formed of an amorphous silicon). Even in cases where the transistor T2 is provided by a TFT which has a relatively high electron mobility such as a CGS (Continuous Grain Silicon)-TFT, the preliminary charging will ensure that a level of display quality is reliably maintained in cases where each scanning line has a relatively short selection period. An example of the oxide TFT is an IGZO-TFT whose channel layer is formed of an oxide semiconductor InGaZnOx (hereinafter called "IGZO") containing indium (In), gallium (Ga), zinc (Zn), and oxygen (O) as primary ingredients.

According to the present embodiment, a preliminary charging is performed in the selection period of the scanning line Si−1 in the (i−1) th row which is the immediately foregoing scanning line in the scanning line Si in the i-th row. One H-period immediately foregoing the main charging period is used as a preliminary charging period. In general images, mutually adjacent pixels are alike, so two pixel circuits 11 adjacent to each other in the column direction have similar data voltages to each other. Under this situation, the preliminary charging performed in the selection period of the scanning line Si−1 in the (i−1) th row brings the gate-source voltage, i.e., a charge in the capacitor C1, even closer to a desired value. This makes it possible to maintain a level of display quality more reliably.

2. Second Embodiment

2. 1 Overall Configuration

Figure 9:
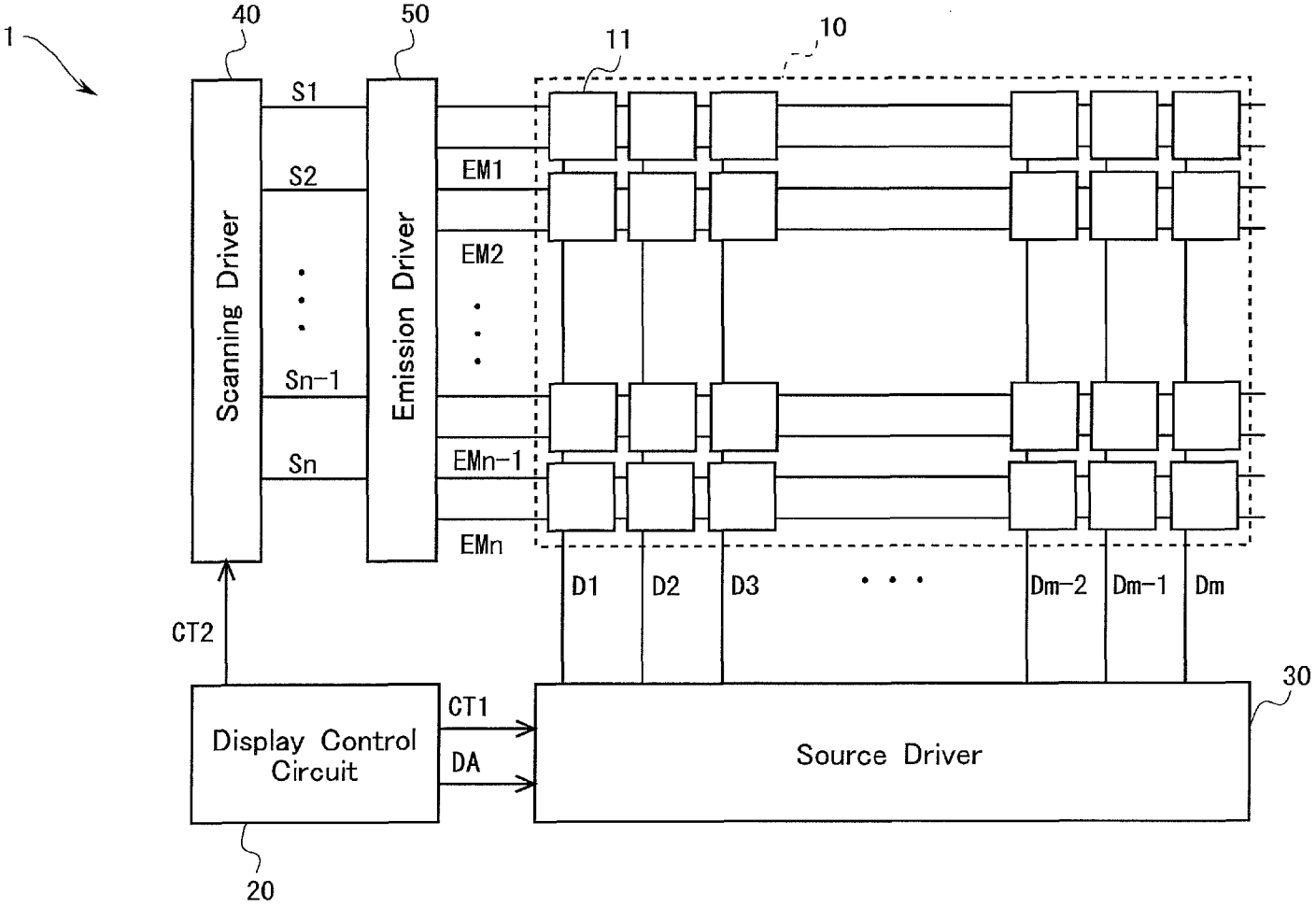
FIG. 9 is a block diagram showing a configuration of an organic EL display device according to a second embodiment of the present invention.

FIG. 9 is a block diagram showing a configuration of an organic EL display device 1 according to a second embodiment of the present invention. Constituent elements of the present embodiment which are identical with those in the first embodiment will be indicated with the same reference symbols, without repeating description thereof when appropriate. Unlike the first embodiment, the emission driver 50 in the present embodiment is disposed together with the scanning driver 40, on the left side of the display section 10. It is acceptable, however, that the scanning driver 40 and the emission driver 50 are both on the right side of the display section 10.

<2. 2 Emission Driver>

Figure 10:
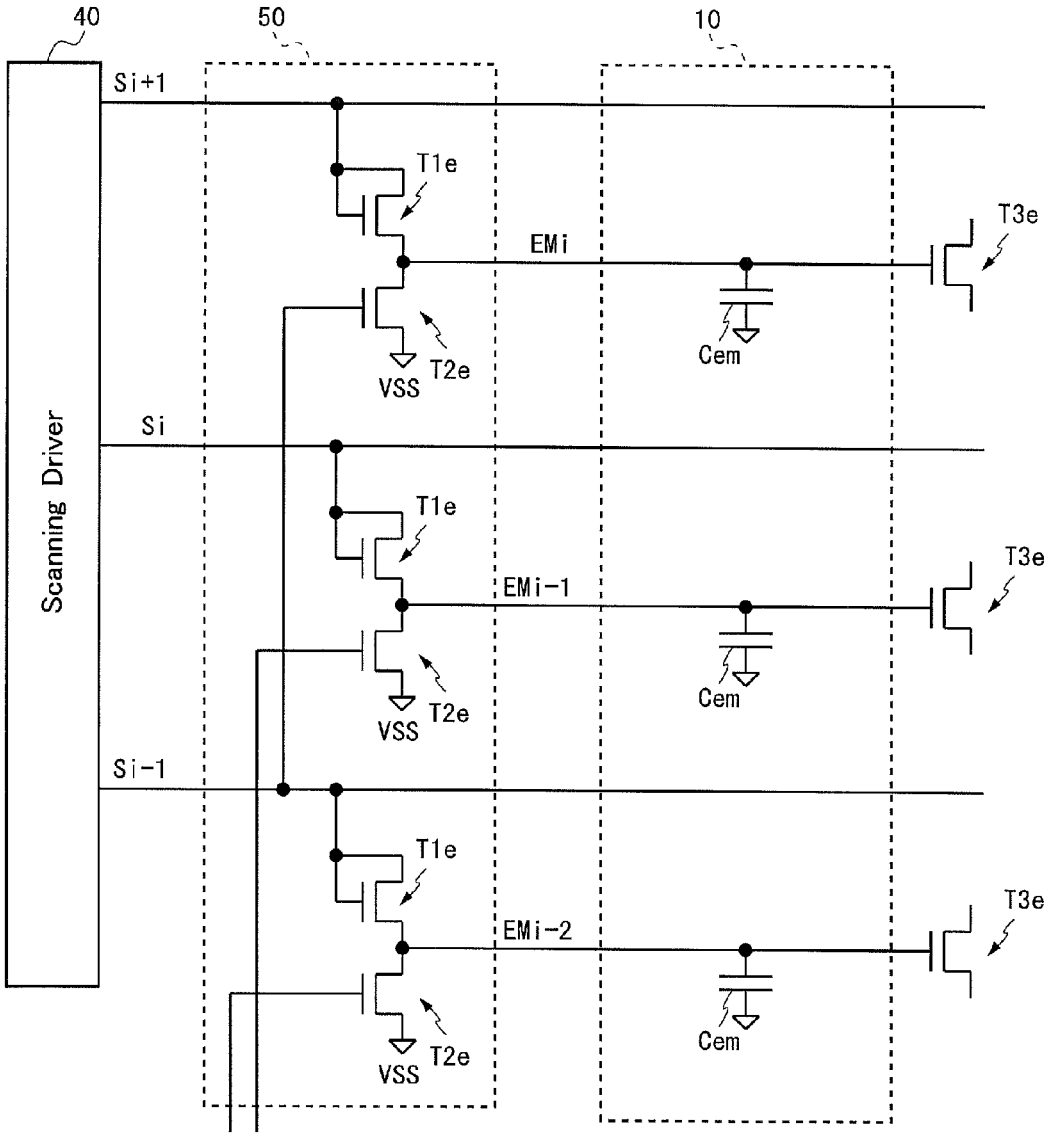
FIG. 10 is a circuit diagram for describing a configuration of an emission driver in FIG. 9.

FIG. 10 is a circuit diagram for describing a configuration of the emission driver 50 in FIG. 9. FIG. 10 shows a configuration of a portion covering the (i−2)th row through the i-th row for the sake of illustrative convenience. As described above, both of the scanning driver 40 and the emission driver 50 are disposed on the left side of the display section 10. More specifically, the emission driver 50 is disposed between the scanning driver 40 and the display section 10 on the left side of the display section 10. The emission driver 50 in the present embodiment has the same configuration as in the first embodiment, so no more description will be made therefor. Also, like the first embodiment, in each row on the side farther from to the scanning driver 40, the emission line has its end provided with a terminal transistor T3*e* as a terminating end for terminating the emission line. It is acceptable to replace the terminal transistor T3*e* with the terminal capacitor C3*e* described earlier, and further, it is acceptable not to provide a terminating end such as the terminal transistor T3*e* and the terminal capacitor C3*e*.

<2. 3 Advantages>

According to the present embodiment, the scanning driver 40 and the emission driver 50 are on the same side (left side) as each other with respect to the display section 10. This allows the emission driver 50 to use sharper scanning line signals which have less deterioration in the waveform. Therefore, the emission driver 50 can accurately drive the n emission lines EM1 through EMn.

3. Third Embodiment

3. 1 Overall Configuration

Figure 11:
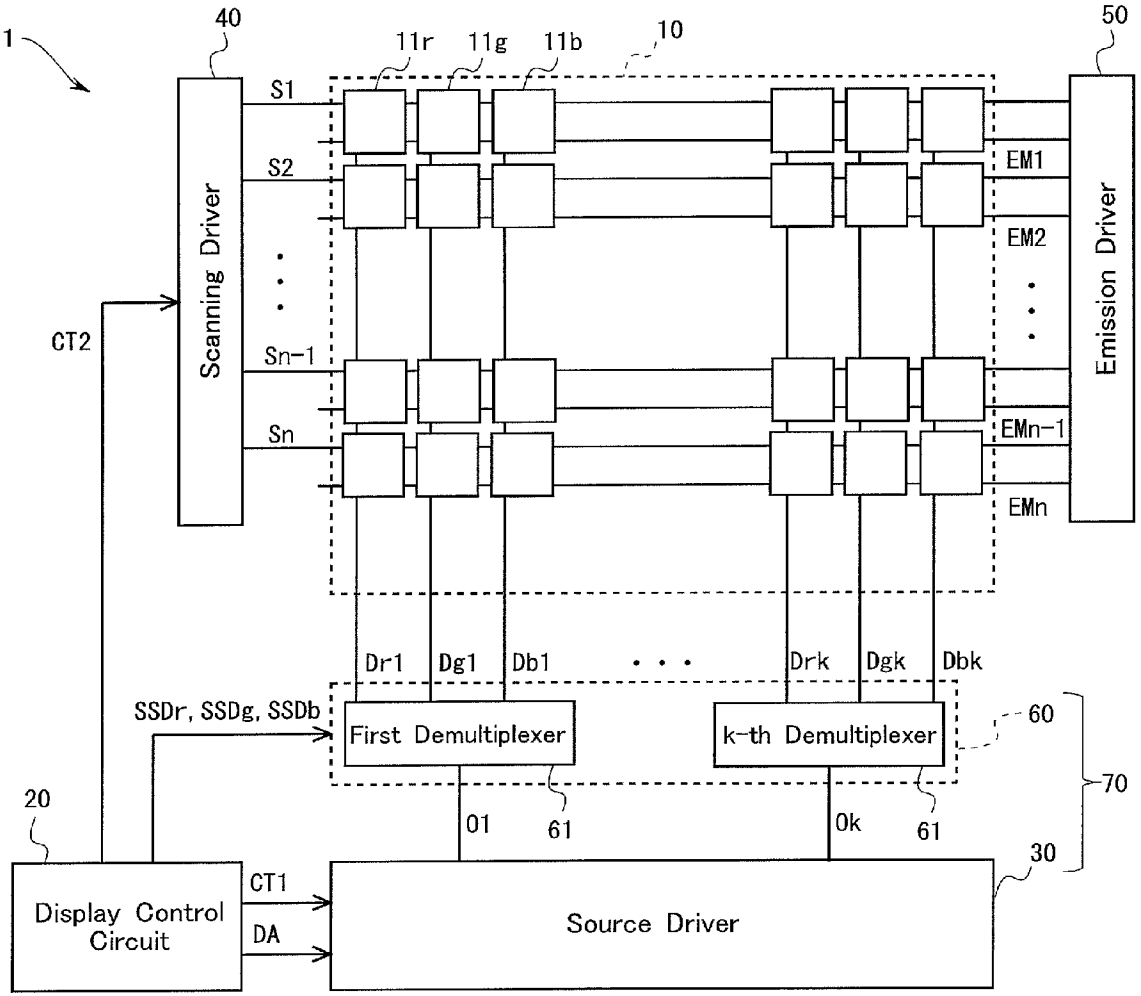
FIG. 11 is a block diagram showing a configuration of an organic EL display device according to a third embodiment of the present invention.

FIG. 11 is a block diagram showing a configuration of an organic EL display device 1 according to a third embodiment of the present invention. Constituent elements of the present embodiment which are identical with those in the first embodiment will be indicated with the same reference symbols (except for those in the pixel circuit 11), and description thereof will not be given when appropriate. The organic EL display device 1 according to the present embodiment provides color display by means of three primary colors of RGB. More specifically, the organic EL display device 1 according to the present embodiment is provided by the organic EL display device 1 according to the first embodiment which further includes a demultiplexer section 60, and employs an SSD (Source Shared Driving) method where data voltages from the source driver 30 to the data lines are supplied via the demultiplexer section 60. In the present embodiment, the source driver 30 and the demultiplexer section 60 constitute a time-sharing data voltage supply section 70.

The display section 10 in the present embodiment is formed with k×l data lines. Note that k×l=m. The symbol 1 represents the number of primary colors for example, and therefore, 1=3 in the present embodiment. Each data line supplies one of a data voltage which represents R (hereinafter called "R-data voltage"), a data voltage which represents G (hereinafter called "G-data voltage"), and a data voltage which represents B (hereinafter called "B-data voltage"). Hereinafter, a data line which supplies R-data voltages will be called "R-data line" and will be indicated with a reference symbol Drj. Likewise, a data line which supplies G-data voltages will be called "G-data line" and will be indicated with a reference symbol Dgj. Also, a data line which supplies B-data voltages will be called "B-data line" and will be indicated with a reference symbol Dbj. The display section 10, more specifically, is formed with k R-data lines Dr1 through Drk; k G-data lines Dg1 through Dgk; and k B-data lines Db1 through Dbk. The display section 10 is also formed with k×l×n pixel circuits 11. In the present embodiment, the pixel circuit 11 which serves as an R sub-pixel will be called "R-pixel circuit" and will be indicated with a reference symbol "11*r*". Likewise, the pixel circuit 11 which serves as a G sub-pixel will be called "G-pixel circuit" and will be indicated with a reference symbol "11*g*". Also, the pixel circuit 11 which serves as a B sub-pixel will be called "B-pixel circuit" and will be indicated with a reference symbol "11*b*". As shown in FIG. 11, in the present embodiment, the R-pixel circuit 11*r*, the G-pixel circuit 11*g* and the B-pixel circuit 11*b* are disposed in an array in this order from the side of the scanning driver 40. However, the sequence of the R-pixel circuit 11*r*, the G-pixel circuit 11*g* and the B-pixel circuit 11*b* in the array is not limited to this, or sub-pixels of other colors may be formed by the pixel circuits 11. As an additional note, the display section 10 is also formed with an initializing line (not illustrated) which supplies an initializing voltage Vini for an initializing operation to be described later (when necessary, the initializing line will be referenced as Vini, using the same symbol as the initializing voltage).

The display control circuit 20 controls the demultiplexer section 60 by sending: a data control signal for R (hereinafter called "R-data control signal" and will be indicated with a reference symbol SSDr); a data control signal for G (hereinafter called "G-data control signal" and will be indicated with a reference symbol SSDg); and a data control signal for B (hereinafter called "B-data control signal" and will be indicated with a reference symbol SSDb), to the demultiplexer section 60.

The source driver 30 has k unillustrated output terminals, and supplies data voltages to k output lines O1 through Ok each connected to one of the output terminals. Each output line is supplied with an R-data voltage, a G-data voltage and a B-data voltage sequentially. The demultiplexer section 60 includes k demultiplexers 61. Each of the k demultiplexers 61 has an unillustrated input terminal, which is connected to one of the k output lines O1 through Ok. The j-th demultiplexer 61 has 1 (1=3) unillustrated output terminals, each connected to one of the R-data line Drj, G-data line Dgj and B-data line Dbj. The demultiplexer 61 receives the sequential supply of an R-data voltage, a G-data voltage and a B-data voltage, and then supplies these to the R-data line Drj, the G-data line Dgj and to the B-data line Dbj in a time-sharing manner. The operation of the demultiplexer 61 is controlled by the R-data control signal SSDr, the G-data control signal SSDg and the B-data control signal SSDb. As has been described, in the present embodiment, the source driver 30 and the demultiplexer section 60 constitute the time-sharing data voltage supply section 70, which supplies R-data voltages, G-data voltages and B-data voltages to the R-data line, the G-data line and the B-data line respectively in a time-sharing manner. If an SSD method is employed, it is possible to decrease the number of output lines which must be connected to the source driver 30 to ⅓, for example, as compared to a case where the SSD method is not utilized.

As shown in FIG. 11, in the present embodiment, the scanning driver 40 and the emission driver 50 are disposed on the left side and the right side of the display section 10, respectively, but the present invention is not limited to this. For example, it is acceptable that the scanning driver 40 and the emission driver 50 are disposed on the right side and the left side of the display section 10 respectively, or both of the scanning driver 40 and the emission driver 50 are disposed on the right side or the left side of the display section 10.

3. 2 Connection Relationship Between Pixel Circuit and Wires

Figure 12:
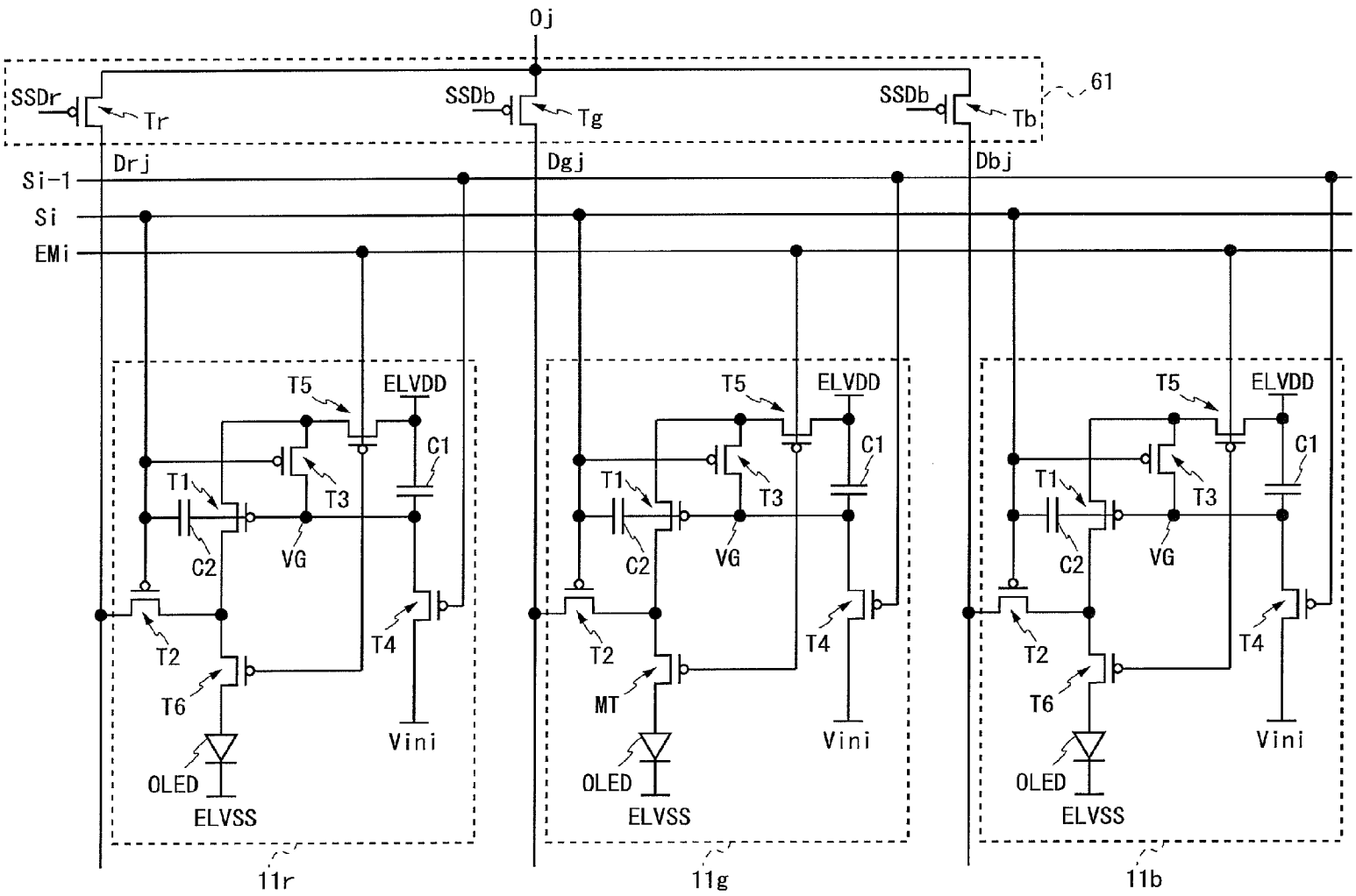
FIG. 12 is a circuit diagram showing a connection relationship between pixel circuits and various wires in the third embodiment.

FIG. 12 is a circuit diagram which shows a connection relationship between the R-pixel circuit 11*r*, G-pixel circuit 11*g* and B-pixel circuit 11*b* in the i-th row and various wires in the present embodiment. It should be noted here that the pixel circuit configuration as shown in FIG. 12 is disclosed in Patent Document 2, for example. First, a configuration of the demultiplexer 61 will be described. As shown in FIG. 12, the demultiplexer 61 has a selection transistor for R (hereinafter called "R-selection transistor" and indicated with a reference symbol Tr); a selection transistor for G (hereinafter called "G-selection transistor" and indicated with a reference symbol Tg); and a selection transistor for B (hereinafter called "B-selection transistor" and indicated with a reference symbol Tb). The R-selection transistor Tr is between the output line Oj and the R-data line Drj, and has its gate terminal supplied with the R-data control signal SSDr. The G-selection transistor Tg is between the output line Oj and the G-data line Dgj, and has its gate terminal supplied with the G-data control signal SSDg. The B-selection transistor Tb is between the output line Oj and the B-data line Dbj, and has its gate terminal supplied with the B-data control signal SSDb.

Next, a configuration of the pixel circuit will be covered. As shown in FIG. 12, the R-pixel circuit 11*r*, the G-pixel circuit 11*g* and the B-pixel circuit 11*b* are disposed sequentially in an array in the row direction. The R-pixel circuit 11*r*, the G-pixel circuit 11*g* and the B-pixel circuit 11*b* are basically the same in their configuration, so the description will take the R-pixel circuit 11*r* as an example, and will not cover the G-pixel circuit 11*g* or the B-pixel circuit 11*b*.

The R-pixel circuit 11*r* has one organic EL element OLED; six transistors T1 through T6; and two capacitors C1, C2. The transistor T1 serves as a drive transistor; the transistor T2 serves as a first input transistor; the transistor T3 serves as a compensation transistor; the transistor T4 serves as an initializing transistor; the transistor T5 serves as a first emission control transistor; and the transistor T6 serves as a second emission control transistor. All of the transistors T1 through T6 are p-channel TFTs. The capacitor C1 represents a drive capacitance element, whereas the capacitor C2 represents a boost capacitance element.

The transistor T1 is in series with the organic EL element OLED, and has its first conduction terminal connected to the HIGH level pixel power supply line ELVDD via the transistor T5. The transistor T2 has its gate terminal connected to the scanning line Si in the i-th row, and is between the R-data line Drj and the second conduction terminal of the transistor T1. The transistor T3 has its gate terminal connected to the scanning line Si in the i-th row, and is between the gate terminal and the first conduction terminal of the transistor T1. The transistor T4 has its gate terminal connected to the scanning line Si−1 in the (i−1)th row, and is between the gate terminal of the transistor T1 and the initializing line Vini. The transistor T5 has its gate terminal connected to the emission line EMi in the i-th row, and is between the first conduction terminal of the transistor T1 and the HIGH level pixel power supply line ELVDD. The transistor T6 has its gate terminal connected to the emission line EMi in the i-th row, and is between the second conduction terminal of the transistor T2 and an anode terminal of the organic EL element OLED. The capacitor C1 is between the gate terminal of the transistor T1 and the HIGH level pixel power supply line ELVDD. The capacitor C2 is between the gate terminal of the transistor T1 and the R-data line Drj. The organic EL element OLED has its cathode terminal connected to the LOW level pixel power supply line ELVSS. In the present embodiment, a term "gate node VG" will be used for the sake of convenience to refer to a point of connection between: the gate terminal of the transistor T1; the conduction terminal of the transistor T3 which is on the gate terminal side of the transistor T1; one terminal of the capacitor C1 and one terminal of the capacitor C2 which are on the gate terminal side of the transistor T1; and the conduction terminal of the transistor T4 which is located on the gate terminal side of the transistor T1.

3. 3 Emission Driver

Figure 13:
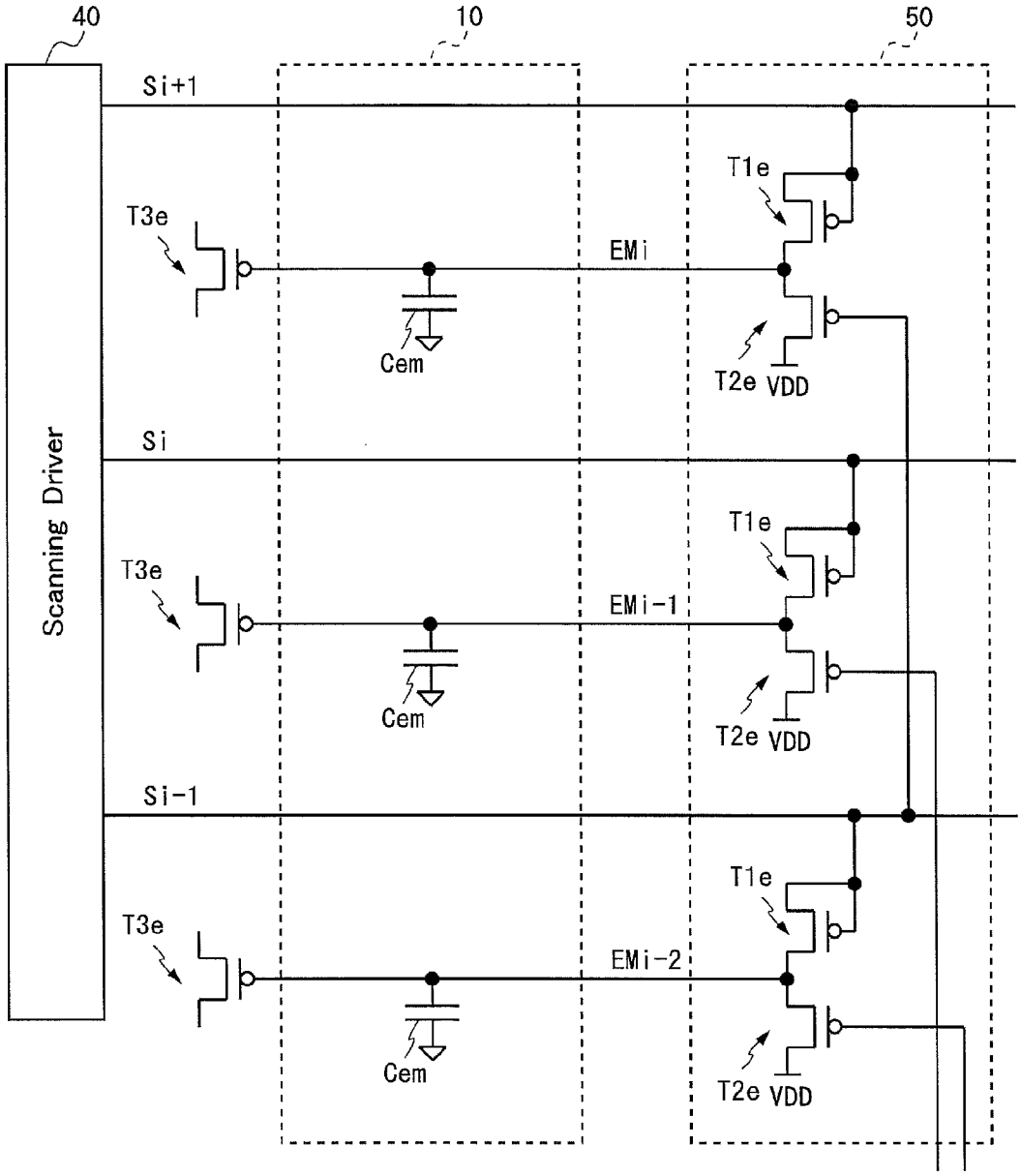
FIG. 13 is a circuit diagram for describing a configuration of an emission driver in FIG. 11.

FIG. 13 is a circuit diagram for describing a configuration of the emission driver 50 in FIG. 11. FIG. 13 shows a configuration of a portion covering the (i−2) th row through the i-th row for the sake of illustrative convenience. The emission driver 50 according to the present embodiment is provided by the emission driver 50 according to the first embodiment which, however, has its ON-control transistor T1*e*, OFF-control transistor T2*e*, and terminal transistor T3*e* provided by a different conductivity type, i.e., the p-channel type. The terminal transistor T3*e* may be provided by an n-channel transistor, however. Also, the terminal transistor T3*e* may be replaced by the terminal capacitor C3*e* described earlier. As still another alternative, no terminating ends may be provided such as the terminal transistor T3*e* and the terminal capacitor C3*e*.

Unlike in the first embodiment, ON level and OFF level in the present embodiment is LOW level (VSS) and HIGH level (VDD) respectively. The OFF-control transistor T2*e* has its second conduction terminal, which is provided by the source terminal, is connected to HIGH level logic power supply line VDD in place of the LOW level logic power supply line VSS. HIGH level logic power supply line VDD has an electric potential equivalent to the HIGH level defined above. All the other connections in the present embodiment are the same as in the first embodiment, so no more description will be made therefor.

3. 4 Operation

Figure 14:
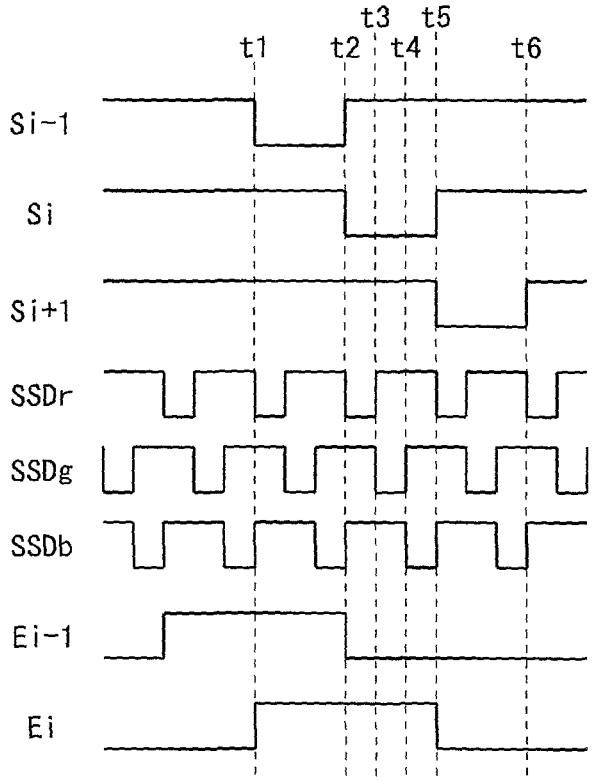
FIG. 14 is a timing chart for describing an operation of the pixel circuit in FIG. 12 and that of the emission driver in FIG. 13.
Figure 15:
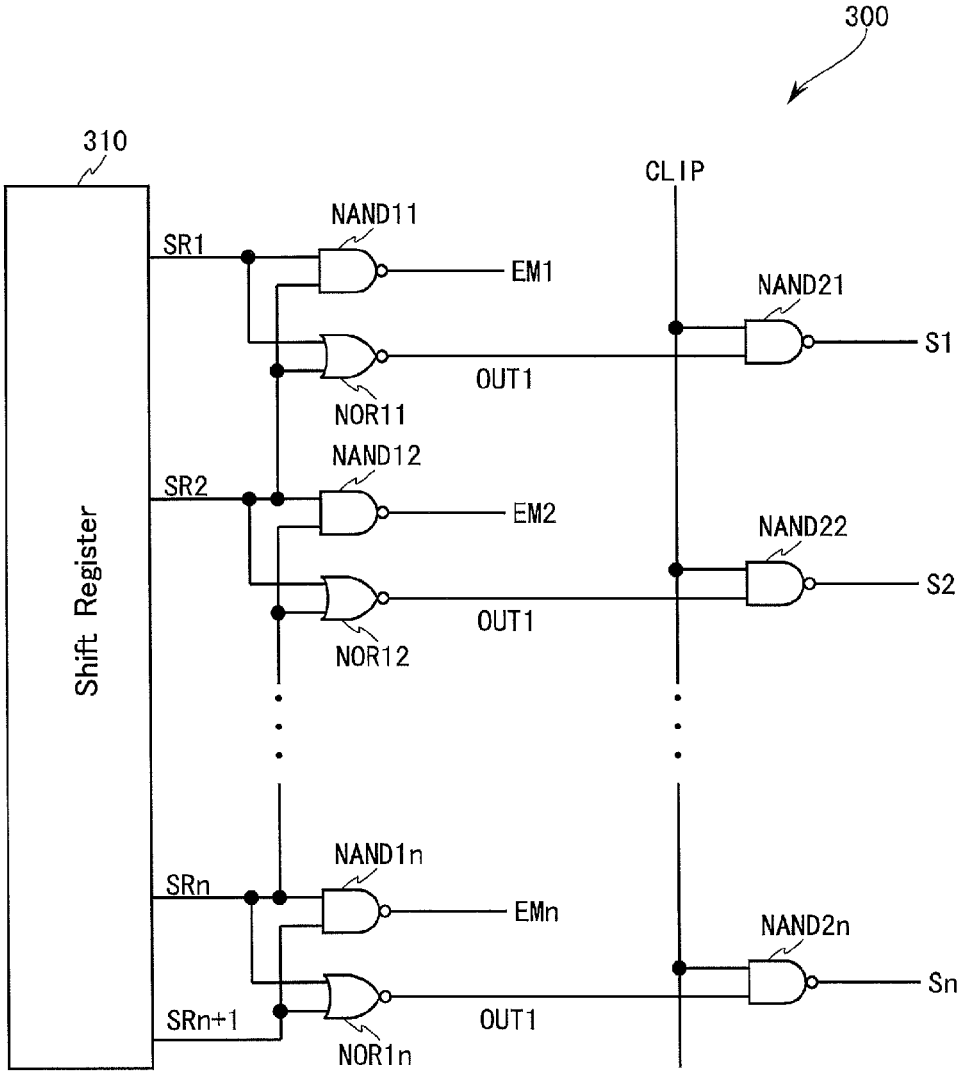
FIG. 15 is a circuit diagram for describing a configuration of a scanning/emission driver.

FIG. 14 is a timing chart for describing an operation of each of the pixel circuits 11 shown in FIG. 12 (hereinafter, simply called "each pixel circuit 11") and an operation of the emission driver 50 shown in FIG. 13. First, an operation of each pixel circuit 11 will be covered with reference to FIG. 12 and FIG. 13. In FIG. 14, a period from Time t1 through Time t2 is a selection period in the (i−1) th row; a period from Time t2 through Time t5 is a selection period in the i-th row; and a period from Time t5 through Time t6 is a selection period in the (i+1)th row. The emission line EMi in the i-th row assumes HIGH level during the selection periods of the scanning lines Si−1 and Si in the (i−1)th row and the i-th row. This high level period partially overlaps a high level period of the emission line EMi−1 in the (i−1)th row, for one H period.

Before Time t1, the scanning lines Si−1 through Si+1 in the (i−1)th row through the (i+1)th row assume HIGH level, whereas the emission line EMi in the i-th row assumes LOW level. Under this situation, in each pixel circuit 11, the transistors T2 through T4 are in OFF state, and the transistors T5, T6 are in ON state. Therefore, the transistor T1 supplies a drive current Ioled, which is determined by a gate-source voltage Vgs held by the capacitor C1, to the organic EL element OLED, and the organic EL element OLED is emitting at a brightness determined by the drive current Ioled.

At Time t1, the emission line EMi in the i-th row changes it state to HIGH level, which turns the transistors T5, T6 OFF in each pixel circuit 11. As a result, electric connection between the first conduction terminal of the transistor T1 and the HIGH level pixel power supply line ELVDD is cut off, and electric connection between the second conduction terminal of the transistor T1 and the anode terminal of the organic EL element OLED is cut off. As a result, the supply of the drive current Ioled by the transistor T1 to the organic EL element OLED is stopped and the organic EL element OLED stops its emission. This suppresses abnormal emission of the organic EL element OLED which can occur when supplying a data voltage to the gate node VG. The emission line EMi in the i-th row stays at HIGH level until Time t5. At Time t1, the scanning line Si−1 in the (i−1)th row changes its state to LOW level, so the transistor T4 turns ON in each pixel circuit 11. As a result, the potential at the gate node VG is initialized to Vini. The initializing voltage Vini has a value capable of keeping the transistor T1 turned ON when the data voltage Vdatai in the i-th row is written into each pixel circuit 11, and more specifically the value satisfies the following mathematical expression.

$$Vini - Vdatai < -Vth \tag{4}$$

Such an initializing operation described above ensures reliable writing of the data voltage into each pixel circuit 11.

When Time t2 is reached, the scanning line Si−1 in the (i−1)th row changes its state to HIGH level, so the transistor T4 turns OFF. This brings the initializing operation to an end. Also, when Time t2 is reached, the scanning line Si in the i-th row changes its state to LOW level, so the transistors T2, T3 turn ON. Further, the R-data control signal SSDr changes its state to LOW level, causing the R-selection transistor Tr to turn ON. This causes the R-data line Drj to be charged to an R-data voltage in the i-th row, and therefore the R-data voltage Vdatai in the i-th row is supplied to the gate terminal of the transistor T1 via the transistors T2, T1, T3. In this step, the first conduction terminal and the second conduction terminal of the transistor T1 function as a drain terminal and a source terminal respectively. Also in this step, the first conduction terminal and the gate terminal of the transistor T1 are electrically connected with each other, whereby the transistor T1 is diode-connected. During the period from Time t2 through Time t5, the potential at the gate node VG changes toward a value given by the following mathematical expression (5):

$$VG = Vdatai - Vth \tag{5}$$

In a more exact sense, the voltage which is supplied to the gate node VG can be lower than Vdatai since the potential held by the R-data line Drj is re-distributed to the R-data line Drj and the capacitors C1, C2. Such an effect, however, is reduced as the potential at the gate node VG is boosted via the capacitor C2 at Time t5 as will be described later.

When Time t3 is reached, the R-data control signal SSDr changes its state to HIGH level, to cause the R-selection transistor Tr to turn OFF. Note that the R-data line Drj can hold the R-data voltage in the i-th row by its own wiring capacitance even after the R-selection transistor Tr is turned OFF. If the wire does not have a sufficient capacitance, however, then an additional capacitor may be connected to the R-data line Drj. During periods from Time t3 through t4 and from Time t4 through t5, the G-pixel circuit 11*g* and the B-pixel circuit 11*b* respectively perform the same operation as performed by the R-pixel circuit 11*r* during the period from Time t2 through t3. Again, there may be an additional capacitor connected to each of G-data line Dgj and B-data line Dbj like the R-data line Drf if their wires do not have a sufficient capacitance.

At Time t5, the scanning line Si in the i-th row changes its state to HIGH level, which turns the transistors T2, T3 OFF in each pixel circuit 11. Also, the emission line EMi in the i-th row changes its state to LOW level, so the transistor T5, T6 turn ON. As a result, electric connection between the first conduction terminal of the transistor T1 and the HIGH level pixel power supply line ELVDD is established, and electric connection between the second conduction terminal of the transistor T1 and the anode terminal of the organic EL element OLED is established. As a result, the transistor T1 supplies a drive current Ioled which is given by the following Mathematical Expression (6) to the organic EL element OLED:

$$\begin{aligned} Ioled &= (\beta/2)*(Vgs - Vth)^2 \\ &= (\beta/2)*(ELVDD - VG - Vth)^2 \\ &= (\beta/2)*(ELVDD - Vdatai)^2 \end{aligned} \tag{6}$$

The Mathematical Expression (6) does not have a term for a threshold voltage Vth. As understood, the present embodiment compensates for variations in the threshold voltage Vth of the transistor T1. Since the scanning line Si in the i-th row changes its state to HIGH level at Time t5, the potential at the gate node VG is boosted via the capacitor C2 as mentioned above. Therefore, although there may be a decrease in the actual voltage supplied to the gate node VG is due to the re-distribution of the potential, the decrease becomes smaller. The transistor T1 supplies the drive current Ioled which is determined by the mathematical expression (6), to the organic EL element OLED also in periods after Time t6.

Next, reference will be made to FIG. 13 and FIG. 14, to describe an operation of the emission driver 50. Before Time t1, the scanning lines Si−1 and Si+1 in the (i−1)th row and the (i+1)th row assume HIGH level, so both of the ON-control transistor T1*e* and the OFF-control transistor T2*e* in the i-th row are in OFF state. This keeps the emission line EMi in the i-th row in a floating state, with its potential maintained at LOW level.

When Time t1 is reached, the scanning line Si−1 in the (i−1)th row changes its state to LOW level, so the OFF-control transistor T2*e* in the i-th row turns ON. This pulls up the potential in the emission line EMi in the i-th row to HIGH level (VDD).

At Time t2, the scanning line Si−1 in the (i−1)th row changes its state to HIGH level, upon which both of the ON-control transistor T1*e* and the OFF-control transistor T2*e* in the i-th row assume OFF state. This brings the emission line EMi in the i-th row into a floating state, with its potential maintained at HIGH level.

When Time t5 is reached, the scanning line Si+1 in the (i+1)th row changes its state to LOW level, so the ON-control transistor T1*e* in the i-th row turns ON. This pulls down the potential in the emission line EMi in the i-th row to LOW level (VSS).

When Time t6 is reached, the scanning line Si+1 in the (i+1)th row changes its state to HIGH level, so the ON-control transistor T1*e* in the i-th row turns OFF. Now, both of the ON-control transistor T1*e* and the OFF-control transistor T2*e* in the i-th row are in OFF state. This brings the emission line EMi in the i-th row into a floating state, with its potential maintained at LOW level. The operation as described for the period from Time t1 through Time t6 is performed also for the emission lines in other rows, whereby the operation of the emission driver 50 according to the present embodiment is implemented.

3. 5 Advantages

According to the present embodiment, it is possible to reduce the size of the data voltage output circuit, by the use of an SSD method.

Also, according to the present embodiment, the transistor T1 becomes diode-connected as the transistor T3 turns ON, and this causes the potential at the gate node VG to be set to a value determined by the threshold voltage Vth of the transistor T1. It is therefore possible to compensate for variations in the threshold voltage Vth of the transistor T1.

<4. Others>

The present invention is not limited to the embodiments described thus far, but may be varied in many ways within the spirit of the present invention. For example, in any of the embodiments, it is not necessary that the ON-control transistor T1*e* in the i-th row has its gate terminal and drain terminal connected to the scanning line Si+1 in the (i+1)th row; it is acceptable as far as they are connected to one of the scanning lines that come after the scanning line Si in the i-th row. The term "the scanning lines that come after" refers to scanning line which come after in the sequence of selection. Also, in any of the embodiments covered thus far, the gate terminal in the OFF-control transistor T2*e* in the i-th row does not have to be connected to the scanning line Si−1 in the (i−1)th row; but it is acceptable as far as it is connected to one of the scanning lines in preceding rows of the scanning line Si in the i-th row, or the scanning line Si in the i-th row. The term "the scanning lines in preceding rows" refers to scanning lines which come before in the sequence of selection. Further, in any of the embodiments, the ON-control transistor T1*e* and/or the OFF-control transistor T2*e* may be provided by other switching elements. Still further, it is not necessary to diode-connect the ON-control transistor T1*e* in the i-th row. For example, it is acceptable that the ON-control transistor T1*e* in the i-th row has its gate terminal not connected to the scanning line Si+1 in the (i+1)th row but to a different control wire, or that the ON-control transistor T1*e* in the i-th row has its drain terminal not connected to the scanning line Si+1 in the (i+1)th row but to a wire which supplies the ON-level voltage.

In the first embodiment, the transistor T3 has its gate terminal connected to the immediately foregoing scanning line; however, it may be connected to one of the scanning lines in preceding rows. Also in the first embodiment, it is acceptable to use the transistor, which has its gate terminal connected to the emission line EMi in the i-th row and is between the drain terminal of the transistor T1 and the HIGH level pixel power supply line ELVDD, in place of the transistor T4 or together with the transistor T4. Again in the first embodiment, the transistor T3 is utilized but the transistor T3 is not essential for the present invention. Also in the first embodiment, two or more of the transistor T3 may be utilized, with their respective gate terminals connected to different scanning lines from each other.

Also, in the first embodiment, the transistors T2, T3 and the transistor T4 are provided by the same conductivity type, but the present invention is not limited to this. For example, the transistors T2, T3 and the transistor T4 may be provided by those of different conductivity types from each other. In this case, the ON-control transistor T1*e* and the OFF-control transistor T2*e* should be provided by different conductivity types, or connections of the ON-control transistor T1*e* and the OFF-control transistor T2*e* should be changed in accordance to the conductivity types of the transistors T2 through T4. Likewise, in the third embodiment, the transistors T1, T2 and the transistors T5, T6 are provided by the same conductivity type, but the present invention is not limited to this. For example, the transistors T1, T2 and the transistors T5, T6 may be provided by those of different conductivity types from each other. In this case, the ON-control transistor T1*e* and the OFF-control transistor T2*e* should be provided by different conductivity types, or connections of the ON-control transistor T1*e* and the OFF-control transistor T2*e* should be changed in accordance to the conductivity types of the transistors T2 through T4.

INDUSTRIAL APPLICABILITY

The present invention is applicable to display devices which employ pixel circuits that include electro-optic elements such as organic EL (Electro Luminescence) elements, and to methods of driving them.

LEGENDS

1 Organic EL Display Device
10 Display Section
11 Pixel Circuit
20 Display Control Circuit
30 Source Driver (Data Driving Section)
40 Scanning Driver (Scanning Driving Section)
50 Emission Driver (Emission Control Driving Section)
60 Demultiplexer Section
70 Time-Sharing Data Voltage Supply Section
D1 through Dm Data Line
S1 through Sn Scanning Lines
EM1 through Emn Emission Lines (Emission Control Lines)
T1 through T6 Transistors
T1*e* ON-Control Transistor (ON-Control Switching Element)
T2*e* OFF-Control Transistor (OFF-Control Switching Element)
T3*e* Terminal Transistor (Terminating End)
C3*e* Terminal Capacitor (Terminating End)
C1, C2 Capacitor
OLED Organic EL Element (Electro-Optic Element)
Vdata Data Voltage
VG Gate Node

The invention claimed is:

1. An active matrix display device, comprising:

a display section including a plurality of data lines, a plurality of scanning lines, a plurality of emission control lines along the respective scanning lines, and a plurality of pixel circuits disposed correspondingly to the data lines, the scanning lines and the emission control lines;

a scanning driving section configured to sequentially select the scanning lines; and an emission control driving section configured to drive the emission control lines;

wherein the pixel circuit includes:

an electro-optic element driven by an electric current;

a first input transistor having its control terminal connected to a corresponding one of the scanning lines, and configured to turns ON when said scanning line is selected;

a drive transistor provided in series with the electro-optic element, and configured to control a drive current that is to be supplied to the electro-optic element, in accordance with a data voltage supplied via a corresponding one of the data lines and the first input transistor; and an emission control transistor having its control terminal connected to a corresponding one of the emission control lines, and provided in series with the electro-optic element; and wherein the emission control driving section includes:

OFF-control switching elements each provided correspondingly to one of the emission control lines and configured to change an electric potential of said emission control line to an OFF level to turn OFF the emission control transistor in accordance with a state of one of the scanning lines which precede the scanning line that is along said corresponding emission control line or a state of the scanning line that is along said corresponding emission control line; and ON-control switching elements each provided correspondingly to one of the emission control lines and configured to change the electric potential of the emission control line to an ON level to turn ON the emission control transistor in accordance with a state of one of the scanning lines which follow the scanning line that is along said corresponding emission control line.

2. The display device according to claim 1, wherein the OFF-control switching element changes the electric potential of the emission control line to the OFF level when one of the scanning lines which precede the scanning line that is along the corresponding emission control line or the scanning line that is along the corresponding emission control line changes its state to a selected state, and the ON-control switching element changes the electric potential of the emission control line to the ON level when one of the scanning lines which follow the scanning line that is along the corresponding emission control line changes its state to a selected state.

3. The display device according to claim 2, wherein the OFF-control switching element has its control terminal connected to one of the scanning lines which precede the scanning line that is along the corresponding emission control line or the scanning line that is along the corresponding emission control line, and has its first conduction terminal connected to the emission control lines, whereas the ON-control switching element has its control terminal connected to one of the scanning lines which follow the scanning line that is along the corresponding emission control line, and has its first conduction terminal connected to the emission control line.

4. The display device according to claim 3, wherein the first input transistor and the emission control transistor are of a same conductivity type, the OFF-control switching element has its second conduction terminal supplied with the OFF-level voltage, and the ON-control switching element has its second conduction terminal connected to the scanning line to which the control terminal is connected.

5. The display device according to claim 3, wherein the control terminal of the OFF-control switching element is connected to an immediately foregoing scanning line of the scanning line that is along the corresponding emission control line.

6. The display device according to claim 3, wherein the control terminal of the ON-control switching element is connected to an immediately following scanning line of the scanning line that is along the corresponding emission control line.

7. The display device according to claim 1, further comprising a terminating end for each emission control line to be terminated.

8. The display device according to claim 1, wherein the pixel circuit further includes:

a drive capacitance element configured to hold a voltage for controlling the drive transistor; and a second input transistor having its control terminal connected to a foregoing one of the scanning lines of the corresponding scanning line;

the first input transistor and the second input transistor being parallel to each other between the corresponding data line and the drive capacitance element.

9. The display device according to claim 8, wherein the first input transistor is provided by a thin-film transistor which has its channel layer formed of an oxide semiconductor, a microcrystalline silicon or an amorphous silicon.

10. The display device according to claim 1, wherein both of the scanning driving section and the emission control driving section are disposed on one side of the display section.

11. The display device according to claim 1, wherein the data voltage represents one of a plurality of primary colors, the pixel circuit serves as a sub-pixel for one of the primary colors, the display device further comprising a time-sharing data voltage supply section configured to supply data voltages each representing one of the primary colors to the data lines in a time-sharing manner, the scanning driving section selects one of the scanning lines when the pixel circuit corresponding thereto is supplied with the data voltage representing the primary color represented by said pixel circuit serving as a sub-pixel.

12. A driving method of an active matrix display device including a display section having a plurality of data lines, a plurality of scanning lines, a plurality of emission control lines along the respective scanning lines, and a plurality of pixel circuits disposed correspondingly to the data lines, the scanning lines and the emission control lines; the pixel circuit including: a first input transistor having its control terminal connected to a corresponding one of the scanning lines, and configured to turn ON when said scanning line is selected; a drive transistor provided in series with the electro-optic element, and configured to control a drive current that is to be supplied to the electro-optic element, in accordance with a data voltage supplied via a corresponding one of the data lines and the first input transistor; and an emission control transistor having its control terminal connected to a corresponding one of the emission control lines, and provided in series with the electro-optic element; the method comprising:

a scanning step of sequentially selecting the scanning lines; and an emission step of driving the emission control lines;

wherein the emission control step includes:

an OFF-control step of controlling OFF-control switching elements each provided correspondingly to one of the emission control lines so as to change an electric potential of the emission control lines to an OFF level to turn OFF the emission control transistor in accordance with a state of one of the scanning lines which precede the scanning line that is along said corresponding emission control line or a state of the scanning line that is along said corresponding emission control line; and an ON-control step of controlling ON-control switching elements each provided correspondingly to one of the emission control lines so as to change the electric potential of the emission control line to an ON level to turn ON the emission control transistor in accordance with a state of one of the scanning lines which follow the scanning line that is along said corresponding emission control line.

* * * * *